US012565743B2

(12) United States Patent
Risi

(10) Patent No.: US 12,565,743 B2
(45) Date of Patent: Mar. 3, 2026

(54) EXCAVATING ASSEMBLY FOR MILLING A ROAD SURFACE OR GROUND

(71) Applicant: SIMEX S.R.L., San Giovanni in Persiceto (IT)

(72) Inventor: Mirco Risi, San Giovanni in Persiceto (IT)

(73) Assignee: SIMEX S.R.L., San Giovanni in Presiceto (IT)

( * ) Notice: Subject to any disclaimer, the term of this patent is extended or adjusted under 35 U.S.C. 154(b) by 302 days.

(21) Appl. No.: 18/034,337

(22) PCT Filed: Oct. 28, 2021

(86) PCT No.: PCT/IB2021/059979
§ 371 (c)(1),
(2) Date: Apr. 27, 2023

(87) PCT Pub. No.: WO2022/090993
PCT Pub. Date: May 5, 2022

(65) Prior Publication Data

US 2023/0392328 A1 Dec. 7, 2023

(30) Foreign Application Priority Data

Oct. 29, 2020 (IT) ..... 102020000025711

(51) Int. Cl.
*E01C 23/088* (2006.01)
*E01C 23/12* (2006.01)
(Continued)

(52) U.S. Cl.
CPC ..... *E01C 23/088* (2013.01); *E01C 23/127* (2013.01); *E02F 3/20* (2013.01); *E02F 3/241* (2013.01)

(58) Field of Classification Search
CPC ..... E01C 23/088; E01C 23/127; E02F 3/20; E02F 3/241; E02F 3/188; E02F 3/183
See application file for complete search history.

(56) References Cited

U.S. PATENT DOCUMENTS 4,878,713 A * 11/1989 Zanetis ..... E02F 5/00 404/90
5,864,970 A 2/1999 Maddock et al.
(Continued)

FOREIGN PATENT DOCUMENTS

EP 0310074 A2 4/1989
EP 1222333 B1 3/2004
(Continued)

OTHER PUBLICATIONS

European Patent Office, International Search Report issued in PCT/IB2021/059979, mailed Feb. 3, 2022, Rijswijk, NL.
(Continued)

*Primary Examiner* — Carib A Oquendo
(74) *Attorney, Agent, or Firm* — Ferguson Case Orr Paterson

(57) ABSTRACT

An excavating assembly for milling and/or scarifying a road surface or ground has a support structure that delimits a compartment housing a cutter rotatable about a cutter axis and a cutter movement unit. A support element, separate from the support structure, rests on the road surface or ground during milling operations. The cutter has a cutter axle extension protruding from the support structure, extending the cutter axis. The support element has an eccentric plate seat rotatably housing an eccentric plate to allow the eccentric plate to rotate about a support element axis. The eccentric plate has a cutter axle extension seat freely and rotatably housing the cutter axle extension. The cutter axis, as extended by the cutter axle extension, is eccentric with respect to the support element axis, defining
(Continued)

a predetermined eccentricity. An eccentric plate movement unit, connected to the eccentric plate, moves the eccentric plate about the support element axis.

24 Claims, 21 Drawing Sheets

(51) Int. Cl.
*E02F 3/20* (2006.01)
*E02F 3/24* (2006.01)

(56) References Cited

U.S. PATENT DOCUMENTS

2002/0195869 A1 12/2002 Dybsetter
2009/0232598 A1* 9/2009 Cochran ..... E01C 23/088 404/86
2014/0042794 A1* 2/2014 Risi ..... E01C 23/088 299/39.4
2020/0141071 A1* 5/2020 Risi ..... E02F 3/20

FOREIGN PATENT DOCUMENTS

EP 1867785 A1 12/2007
EP 2495367 A1 9/2012
EP 2735654 A1 5/2014
GB 2512945 A 10/2014
WO 2014063917 A1 5/2014

OTHER PUBLICATIONS

European Patent Office, International Written Opinion issued in PCT/IB2021/059979, mailed Feb. 3, 2022.

* cited by examiner

EXCAVATING ASSEMBLY FOR MILLING A ROAD SURFACE OR GROUND

CROSS-REFERENCE TO RELATED APPLICATIONS

This application is a National Phase Application of PCT International Application No. PCT/IB2021/059979, having an International Filing Date of Oct. 28, 2021 which claims the benefit of priority to Italian Patent Application No. 102020000025711, filed Oct. 29, 2020, each of which is hereby incorporated by reference in its entirety.

FIELD OF THE INVENTION

The present invention relates to the field of systems and methods for milling pavement, such as asphalt and/or concrete.

In particular, the present invention relates to the field of cutter assemblies that may be removably applied or secured to a vehicle, such as a skid steer loader or skid loader or an excavator, for example at the front in relation to the direction of movement thereof, so that the vehicle pushes the excavating assembly placed in front of the wheels or tracks of the vehicle.

The subject matter of the present invention is a excavating assembly for a operating machine, a operating machine comprising said equipment, and a method for adjusting the assembly.

In particular, the subject matter of the present invention is a excavating assembly for milling and/or scarifying a road surface or ground to be milled by varying the milling or excavating depth.

In addition, the subject matter of the present invention is also, in particular, a excavating assembly for milling or scarifying asphalt or concrete, an assembly to be installed as auxiliary equipment on a self-propelled machine, generally including those for earth work, road work, construction, and so on, with multiple functions, such as skid steer loaders, or skid loaders for short, or mini self-propelled loaders, but also excavators or tractors.

PRIOR ART

Various pieces of milling or scarifying equipment are currently commercially available, some of which are patented in the name of the current applicant Simex Engineering (EP1222333B1 or EP2495367A1). In particular, this known solution solves the problem of the so-called "flatness of the equipment used on the ground," i.e. runners that remain on the road surface and adjust the cut depth, which obviously must remain constant with varying angles of the scarifying cutter in relation to the support surface, which may vary due to potential, but not unlikely, drops in the pressure of the hydraulic cylinders that hold the equipment in place, or due to breaks in the ground where the self-propelled vehicle is working.

Other solutions are known from U.S. Pat. No. 5,864,970A1, US2002/195869A1, EP2735654A1, U.S. Pat. No. 4,878,713, GB2512945, EP0310074, WO2014/063917, and EP1867785A1.

These solutions aim to position the runners allowing for translation or roto-translation with respect to the theoretical center of the cutter, by positioning the runners according to the slope of the terrain and substantially adhering to the ground, thus preventing the runners from touching the ground only partially, with the front or rear portion depending on the misalignment situation between the support elements and the ground, thereby causing an undesirable variation in the working depth compared to the desired value.

However, the solutions proposed thus far do not precisely adjust the position of the support runners of the excavating assembly with respect to the physical center of rotation of the cutter.

Furthermore, the known solutions for allowing for the translation or roto-translation of the runners require plates or partitions having guides or slots that sometimes create large openings that act as passageways for dust and debris to come out of the structure containing the cutter. It is not rare for debris to be thrown out of the cutter structure, requiring operators to retrieve the material in order to bring it back into the milled area or to dispose of it.

In addition, the known solutions, precisely because they enable relative movement between the runners and the cutter, have numerous levers and actuators held by the support structure of the cutter, thus creating difficulties in positioning accessories that are sometimes used for milling operations, such as tanks for fluids for wetting the milled material, for example to keep down dust.

Consequently, there is a need to propose a milling assembly that allows for precise adjustment of the position of the runners with respect to the center of rotation of the cutter and, at the same time, makes it possible to meet the contrasting needs to contain the milled material during the milling operations and the additional contrasting need to simplify the construction and layout of the excavating assembly, including to facilitate the use of accessories.

The present invention falls within the above context, aiming to provide a milling assembly, a operating machine, and an adjustment method capable of overcoming these drawbacks.

SUMMARY OF THE INVENTION

These and other objects are achieved by an excavating assembly, an operating machine and an adjustment method as described and claimed herein.

Some advantageous embodiments are the subject of the dependent claims.

The solutions proposed as described in the enclosed claims overcome the drawbacks mentioned in reference to the solutions of the prior art.

Thanks to the proposed solutions, the excavating assembly is adjusted by rotation about the physical axis of rotation of the cutter, resulting in a very precise movement of the assembly, in particular much more precise than the solutions of the prior art, in which the assembly rotates about a virtual axis, often by roto-translation and not rotation, along a virtual path.

Furthermore, thanks to the proposed solutions, the support structure is closed all around the cutter, providing greater safety for operators and preventing debris from being thrown out through the openings between the upper, front, and rear sides and plates.

Furthermore, the proposed solution of the excavating assembly leaves ample free space, for example above the cutter support structure, for associating accessories with the assembly, such as a tank for water to be sprayed during the milling process to reduce particles in suspension. Also, thanks to the very ample space, the view of the operator of the vehicle or operating machine is enhanced.

Thanks to the proposed solutions, it is possible to connect the excavating assembly 1 to a skid loader which is known to have an access opening for an operator in the front, that is, facing the excavation equipment, and make it possible to park the excavation equipment with the tool resting on a surface to be worked on and, at the same time, keep said access opening of the skid loader accessible while leaving the excavation equipment 1 attached to the skid loader, to allow the operator inside the skid loader to come out without having to first disconnect the excavating assembly 1 from the skid loader.

FIGURES

Further features and advantages of the invention will become clear from the description given below of its preferred embodiments as non-limiting examples, in reference to the attached figures, wherein.

Figure 1:
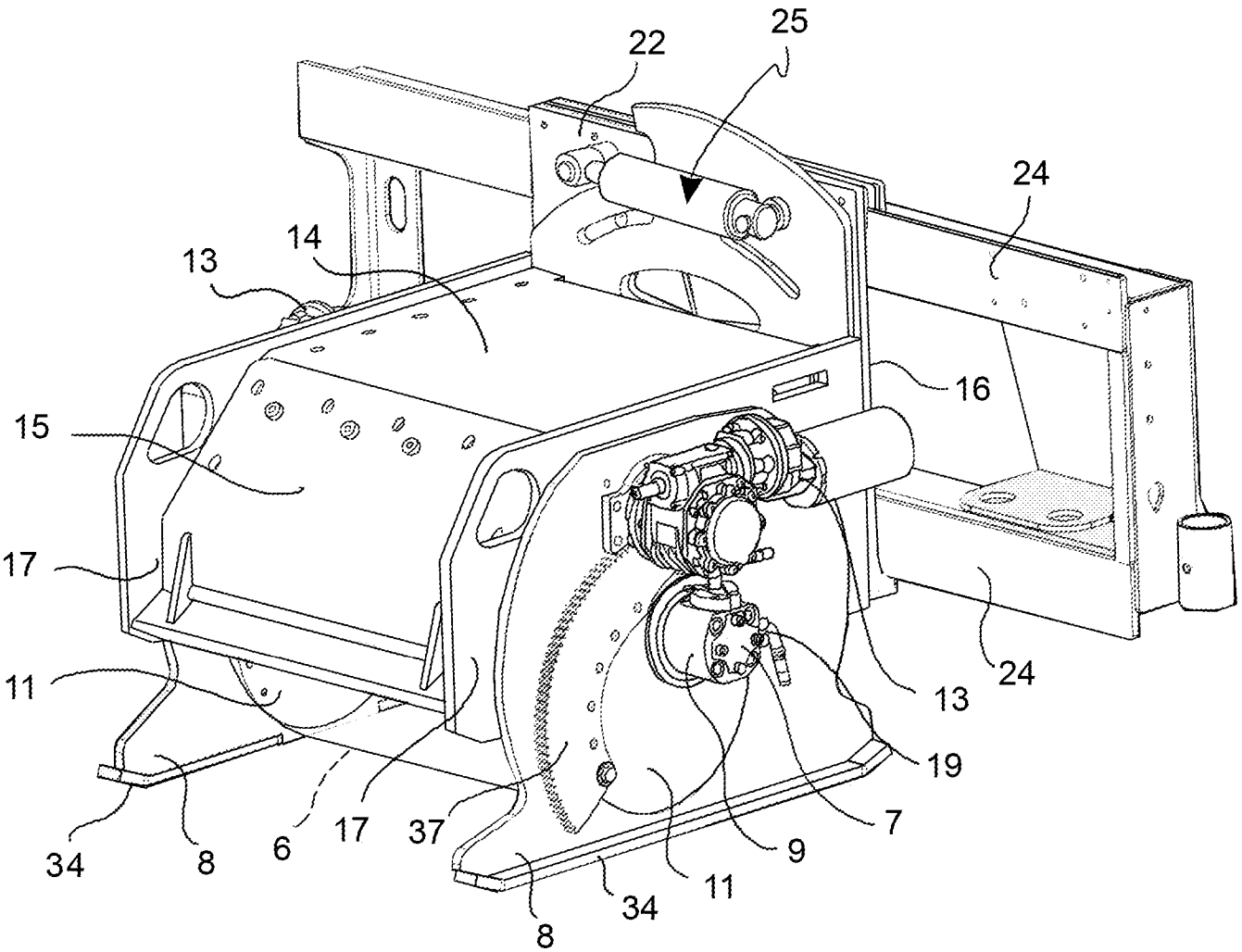
FIG. 1 is a perspective view of a excavating assembly according to the present invention.
Figure 2:
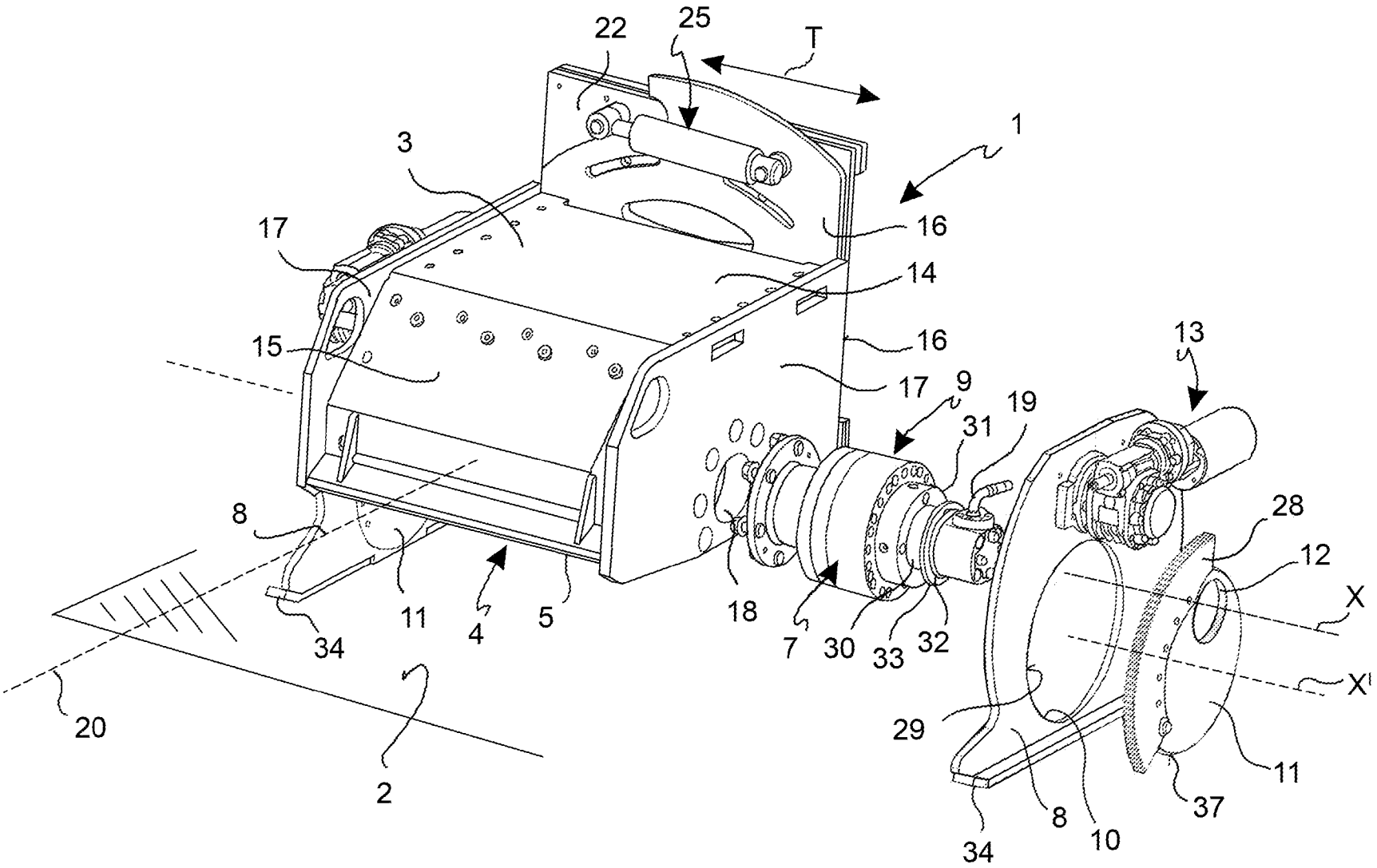
FIG. 2 shows an exploded perspective view of the excavating assembly in FIG. 1, in which the cutter has been removed and the motor contained in the support structure is shown outside the support structure, but arranged with the axis coinciding with that which it would have when installed inside the support structure.
Figure 3:
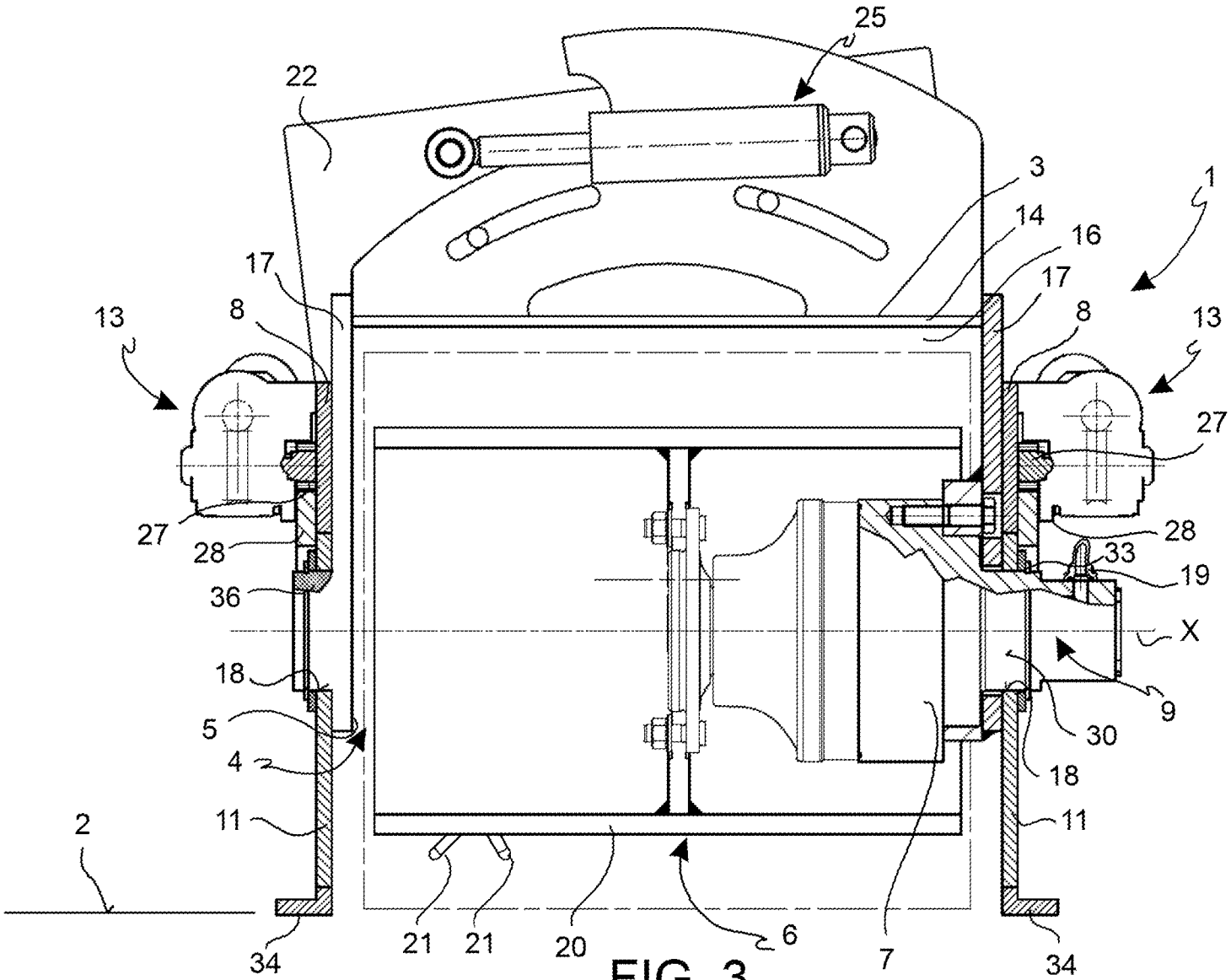
FIG. 3 shows a front cross-sectional view of the assembly in FIG. 1 in which the motor is also shown with a partial cross-section.
Figure 5:
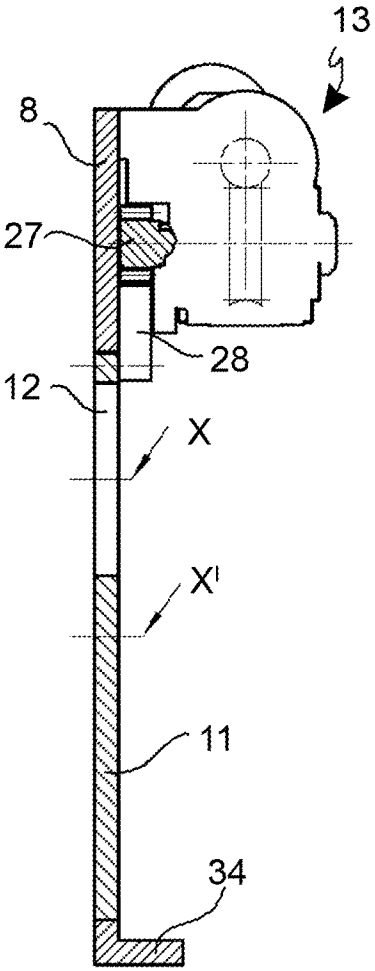
FIG. 5 shows a cross-section along a plane passing through the vertical line and support element axis X' of the support element in FIG. 4.
Figure 4:
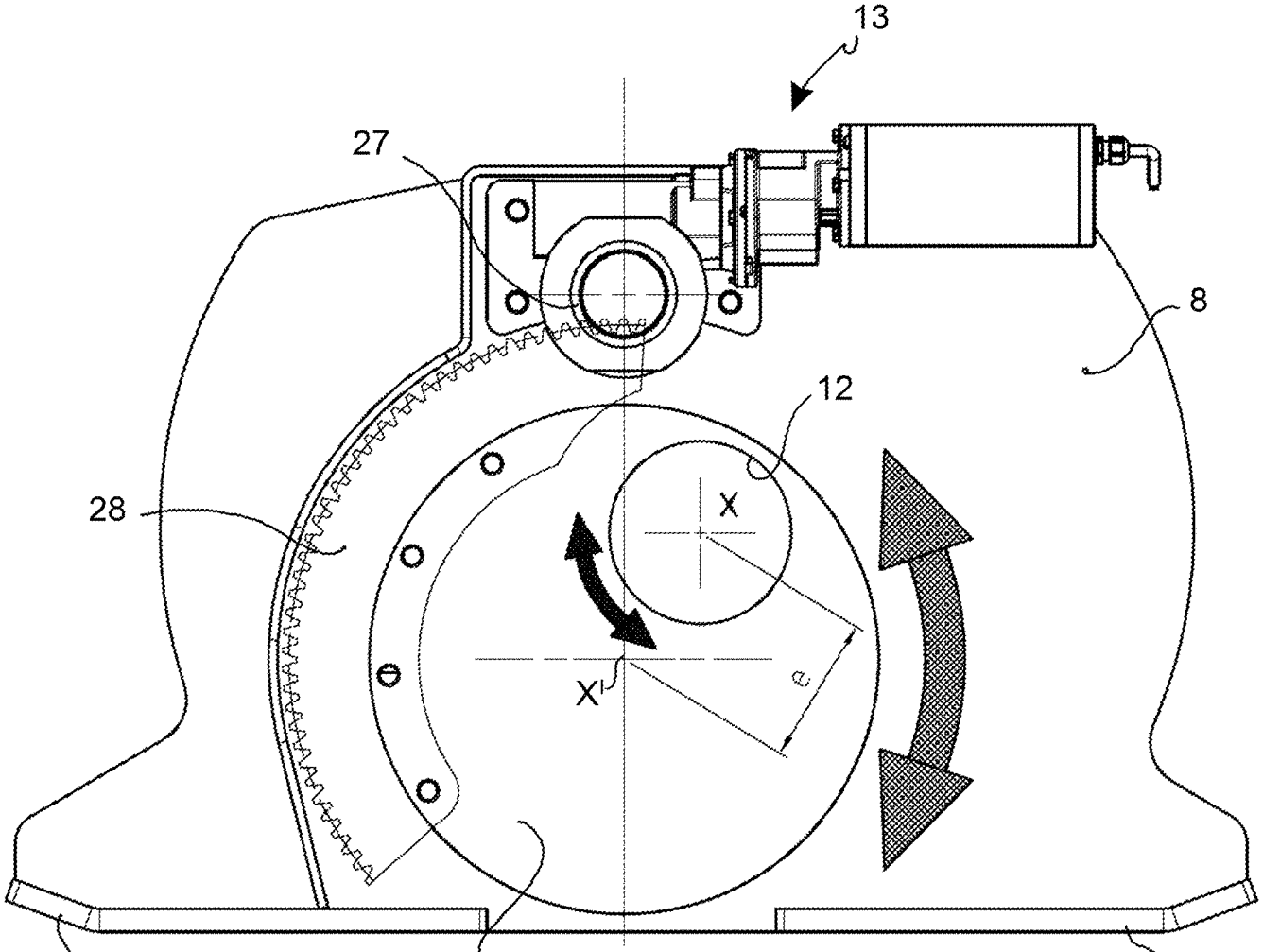
FIG. 4 shows a side view of only the support element of the assembly in FIG. 1.
Figure 8:
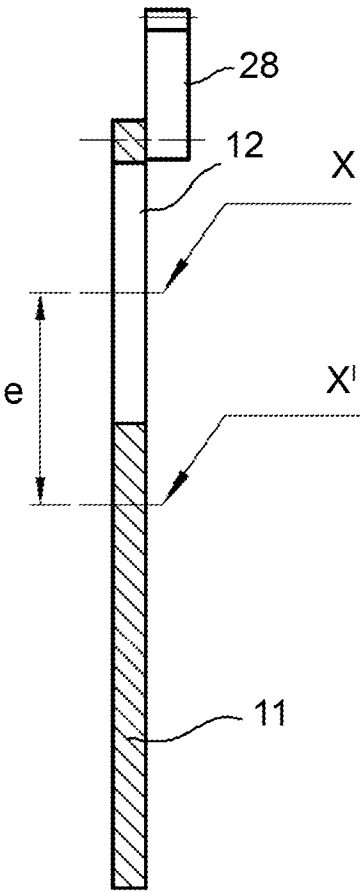
FIG. 8 shows a cross-section along line VIII-VIII in FIG. 7 of the eccentric plate.
Figure 7:
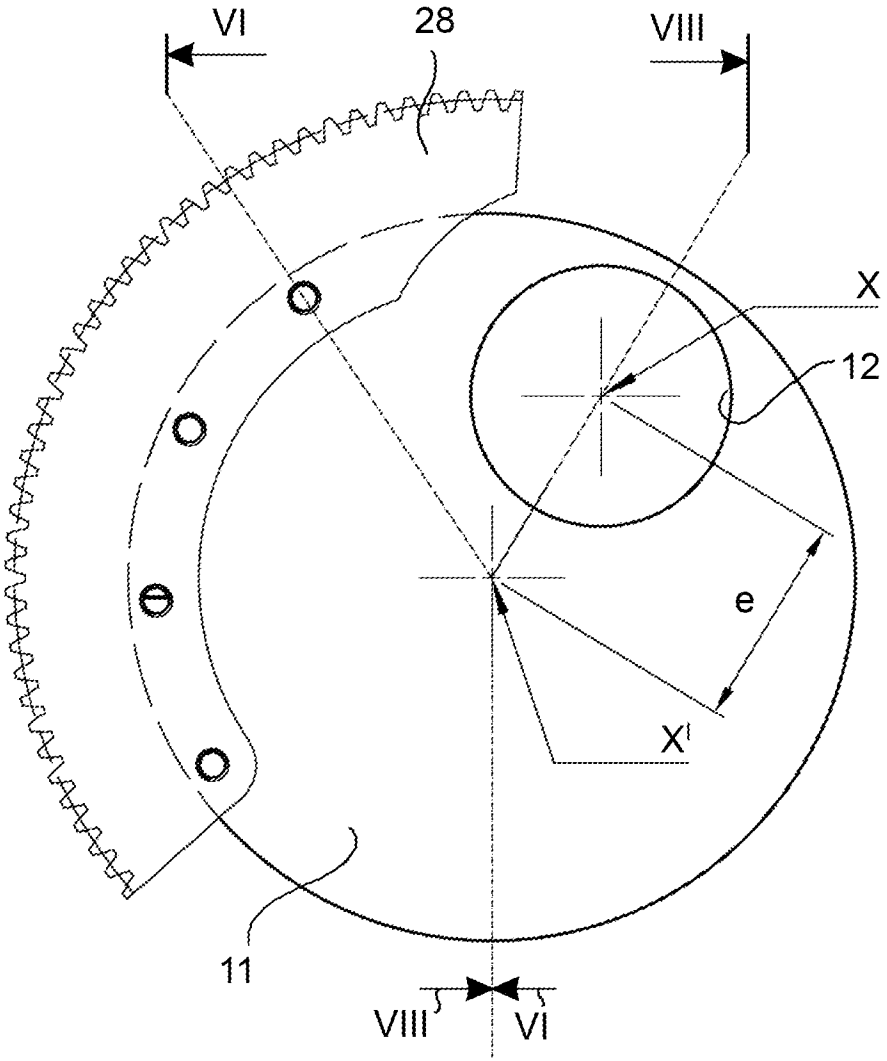
FIG. 7 shows a side view of the eccentric plate of the assembly in FIG. 1.
Figure 6:
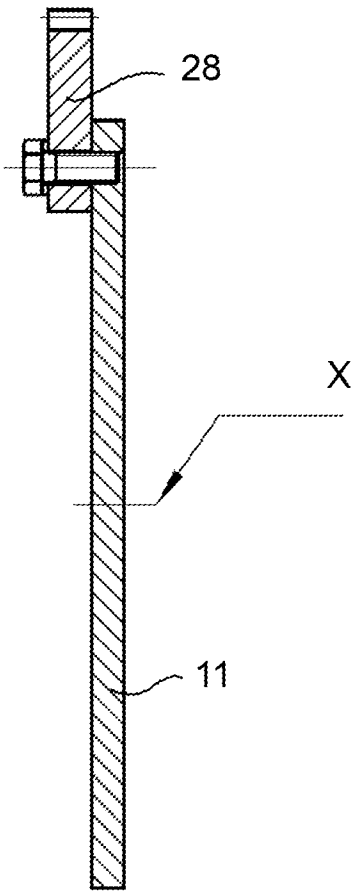
FIG. 6 shows a cross-section along line VI-VI in FIG. 7 of the eccentric plate.
Figure 9:
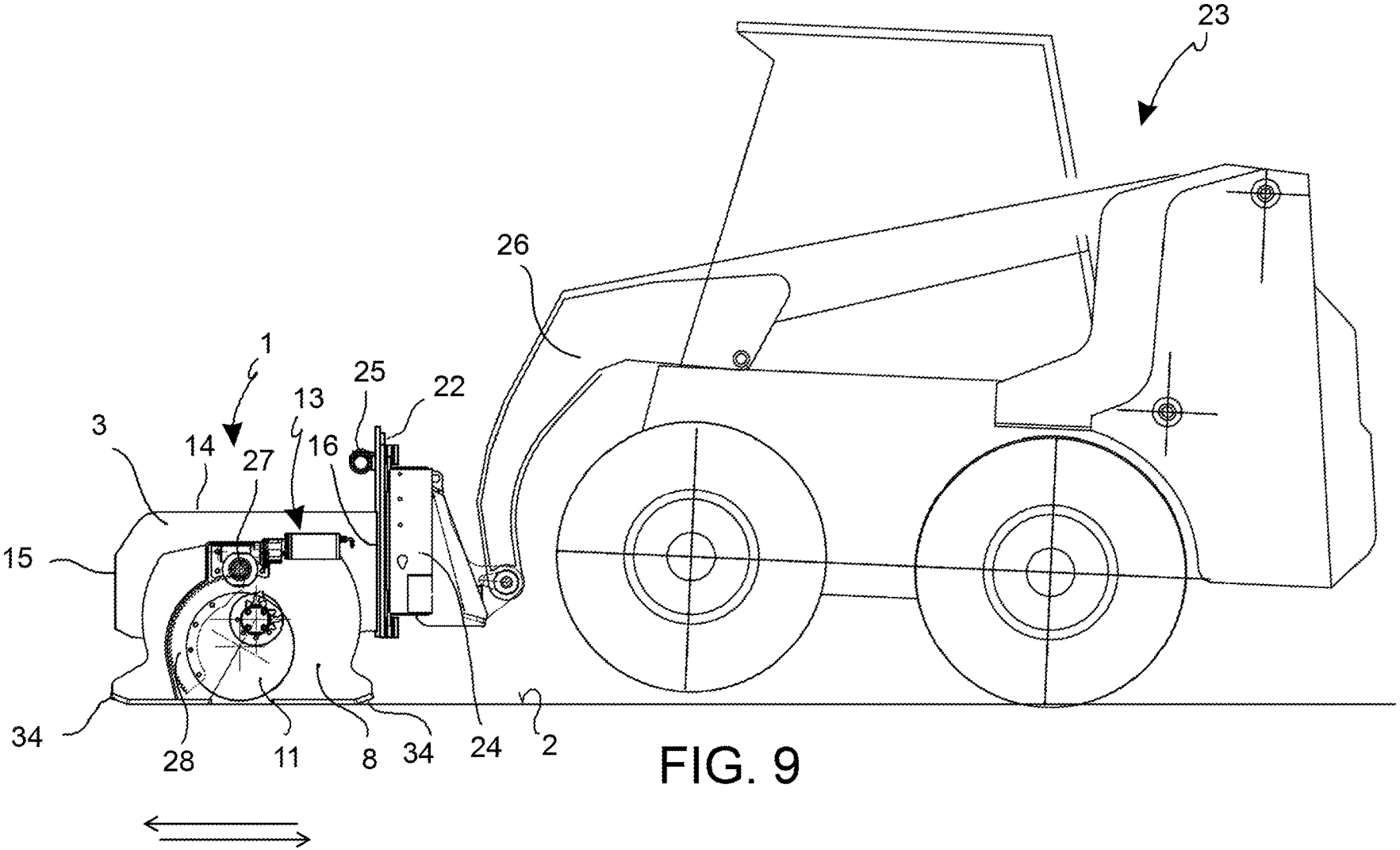
FIG. 9 shows a side view of a milling assembly installed at the front of a skid loader during a milling operation on a road surface or ground to be milled; as indicated in the figure, the direction of milling movement may coincide with the direction of forward movement of the skid loader or the direction of backward movement of the skid loader.
Figure 10:
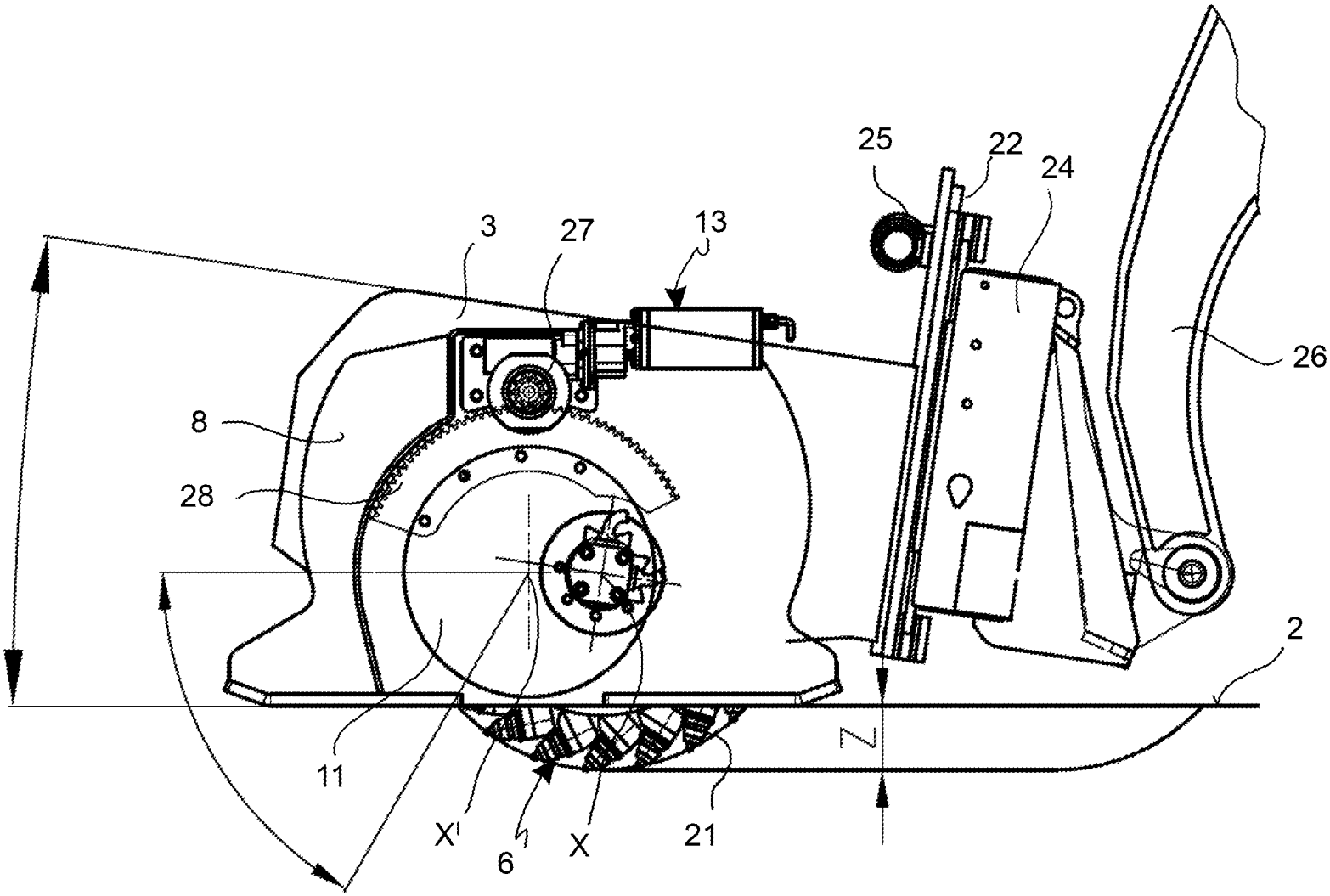
Figure 11:
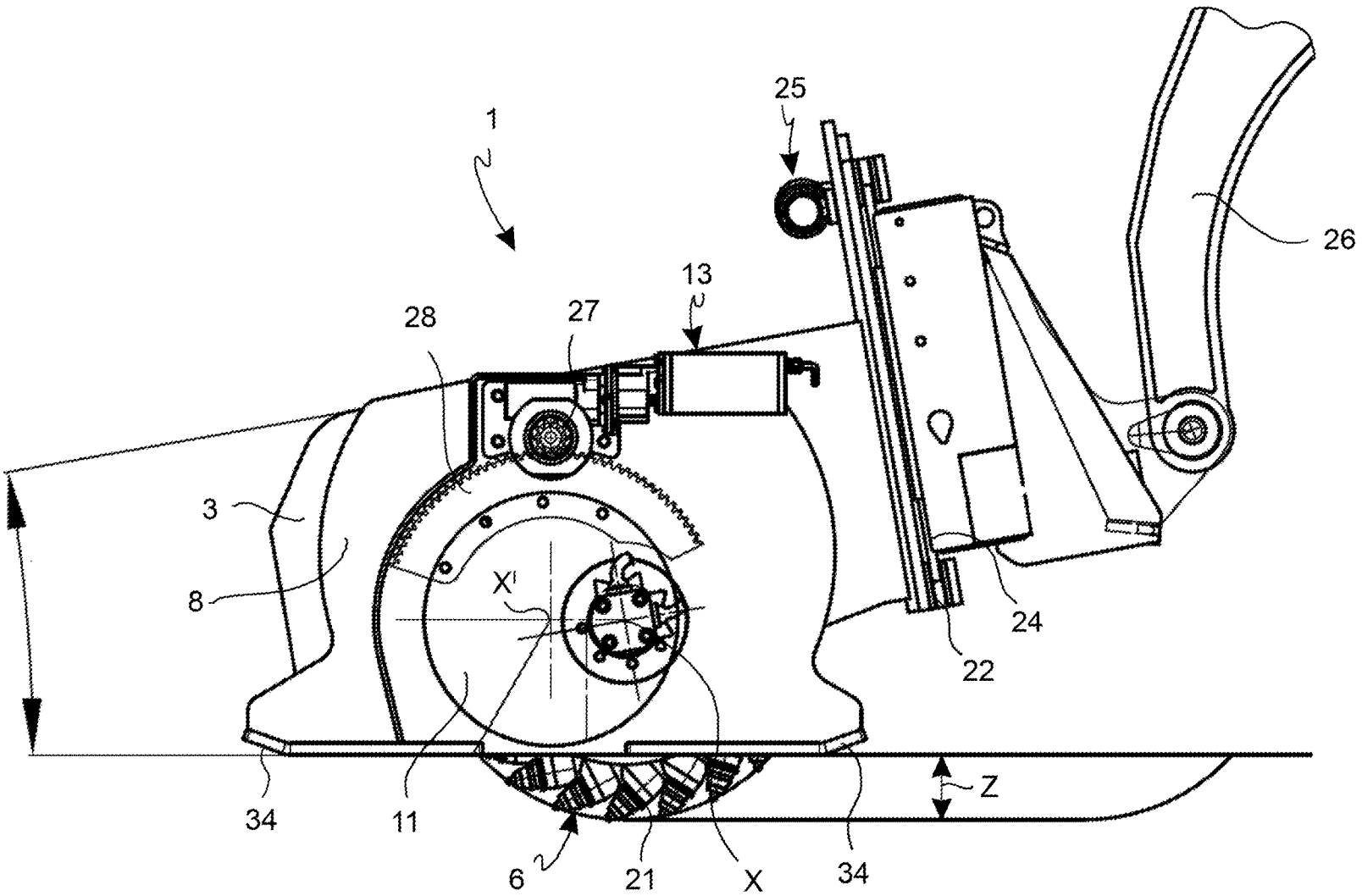
Figure 12:
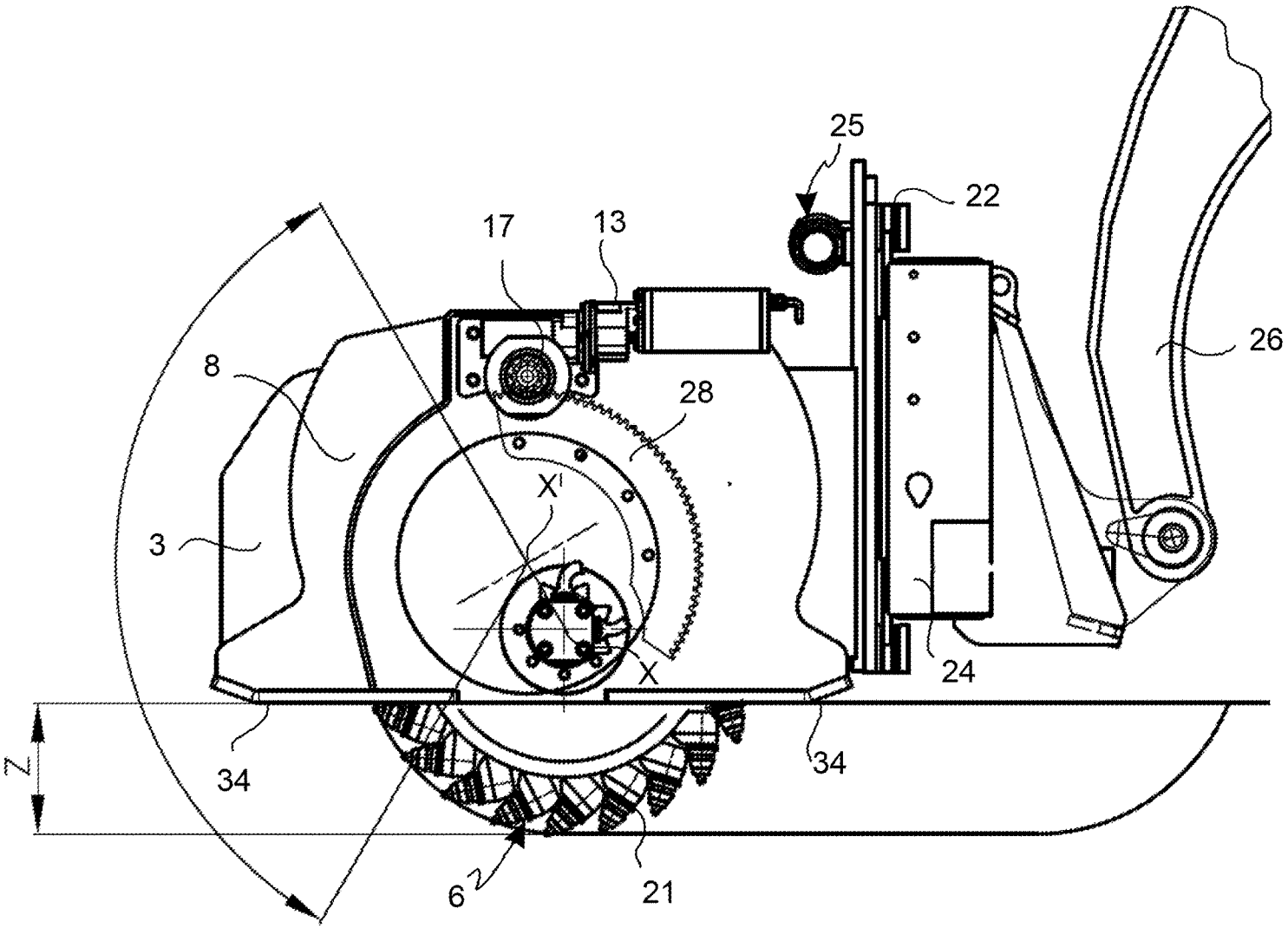
Figure 14:
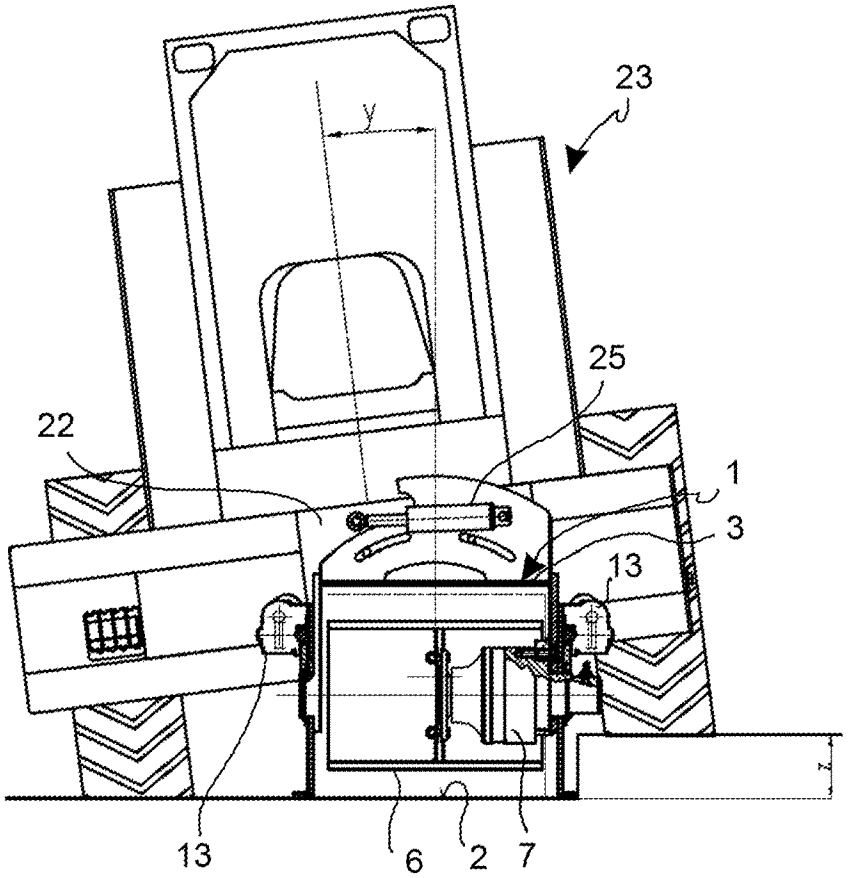
Figure 13:
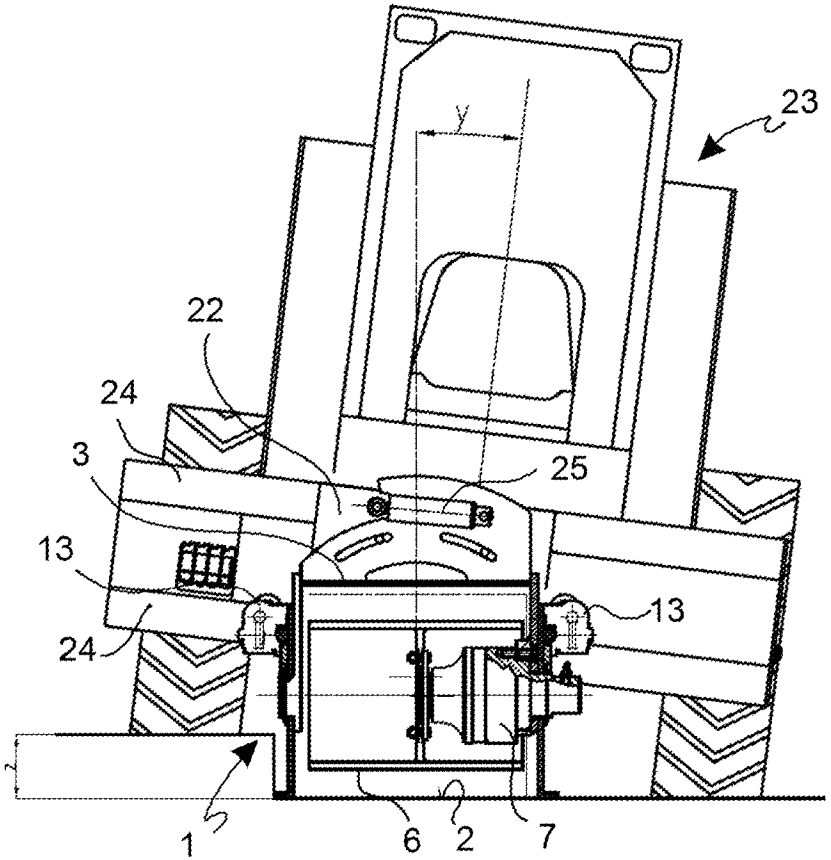
Figure 15:
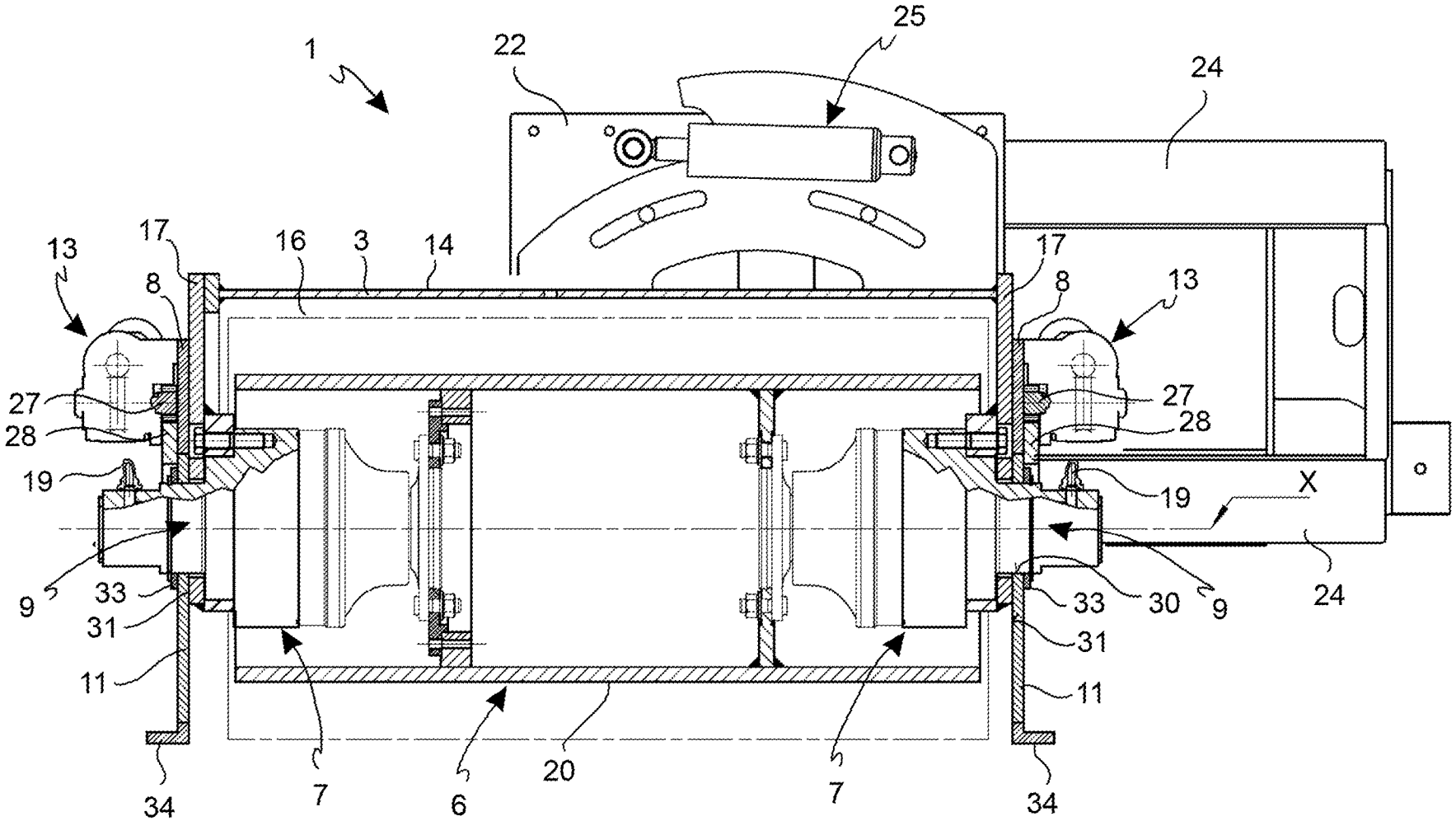
Figure 16:
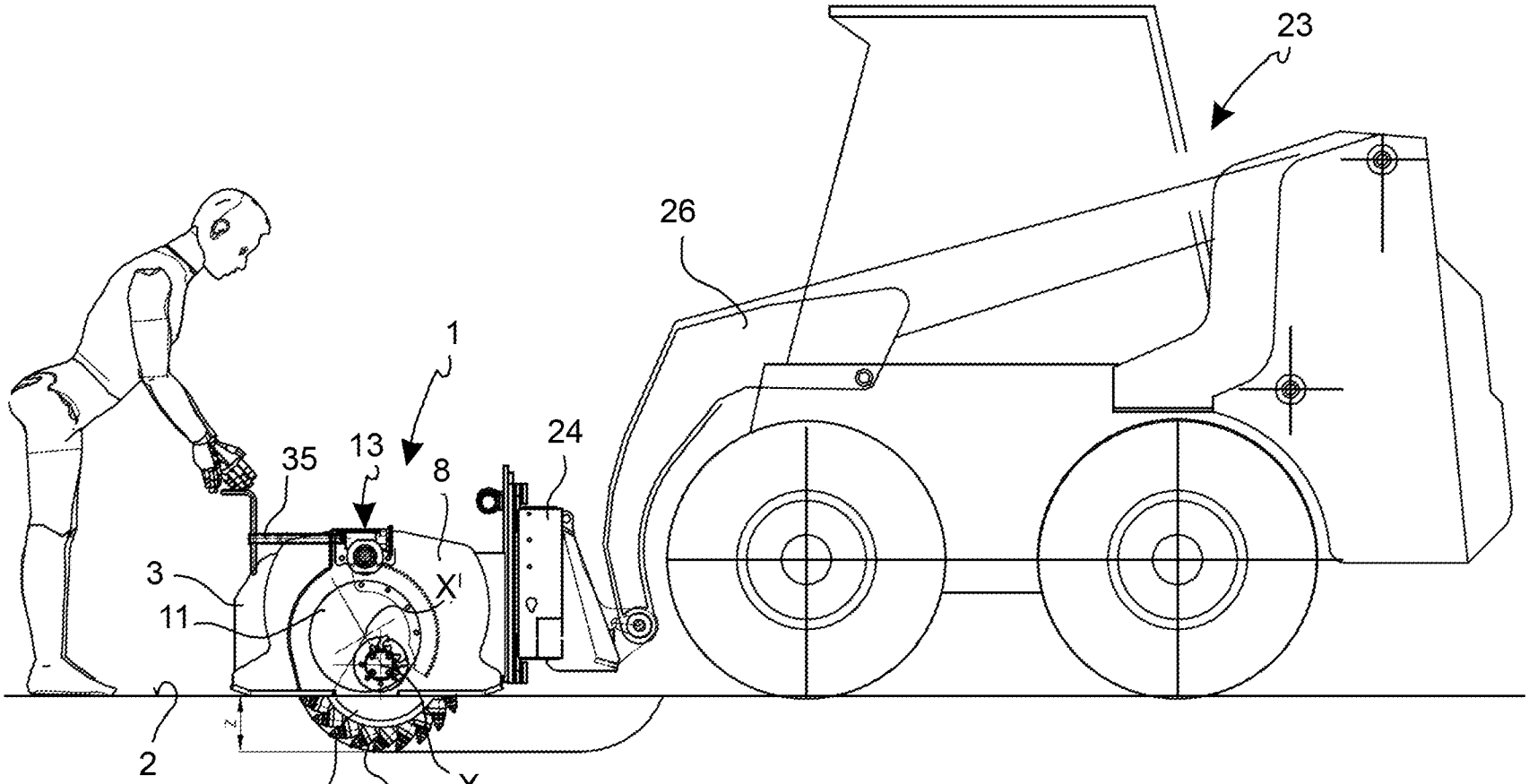
Figure 19:
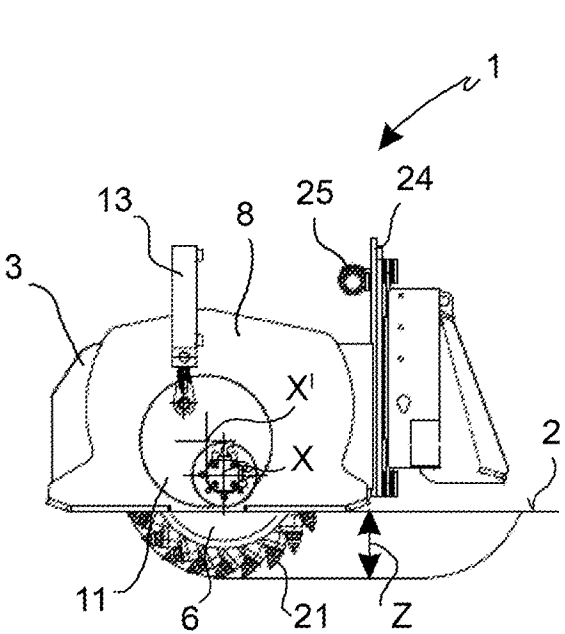
Figure 18:
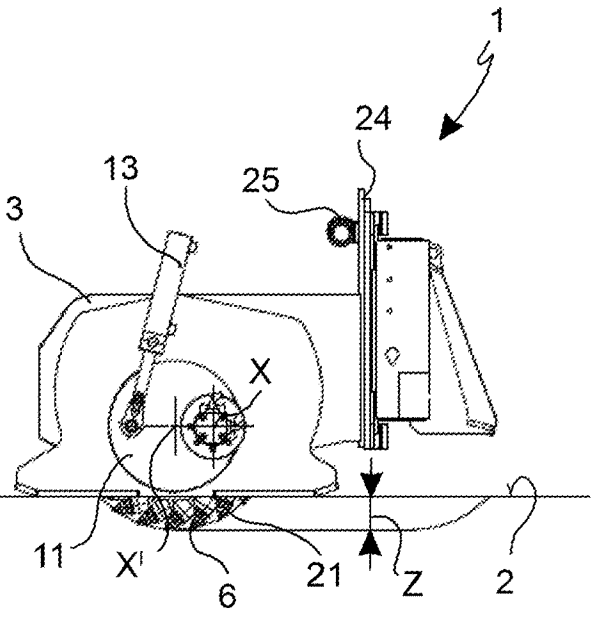
Figure 17:
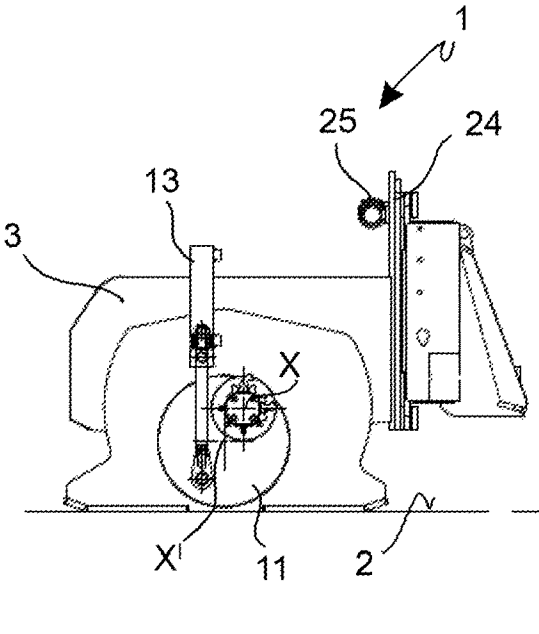
Figure 21:
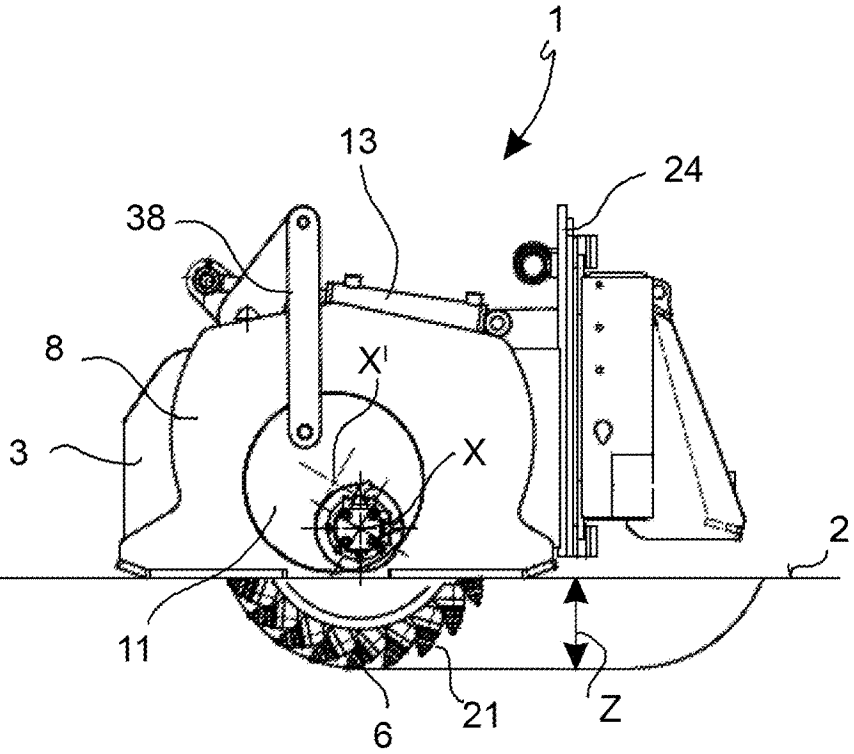
Figure 20:
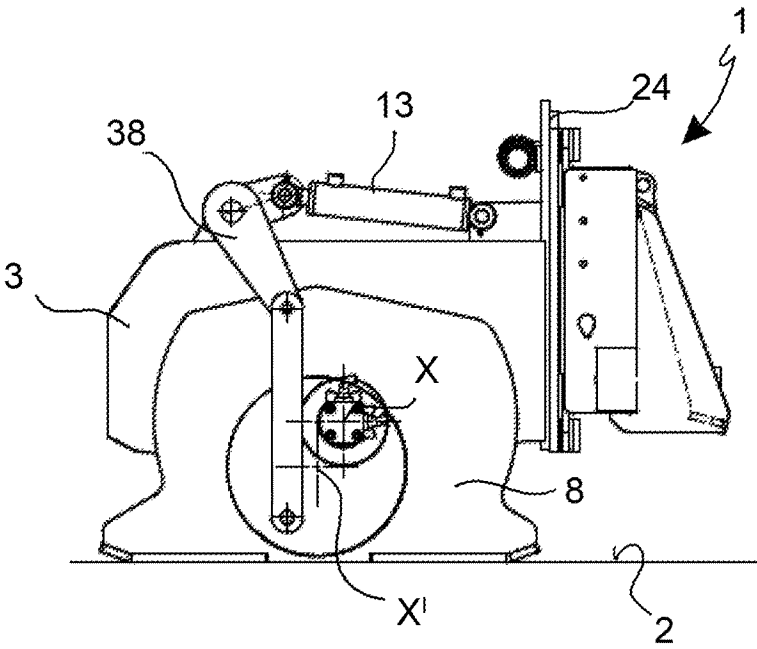
Figure 23:
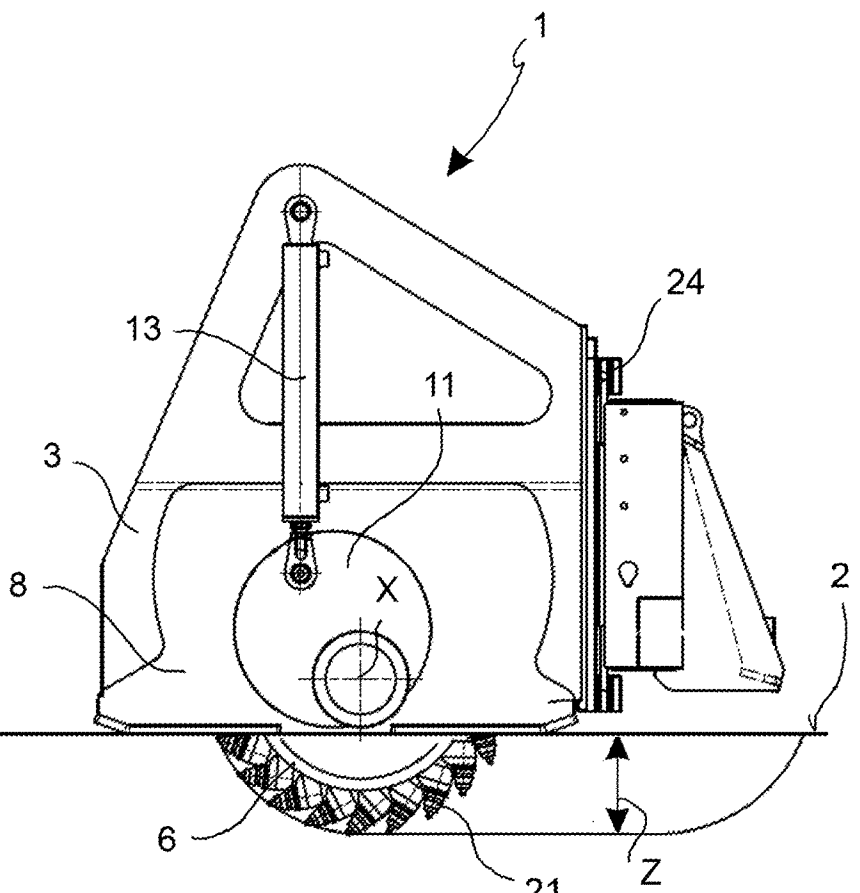
Figure 22:
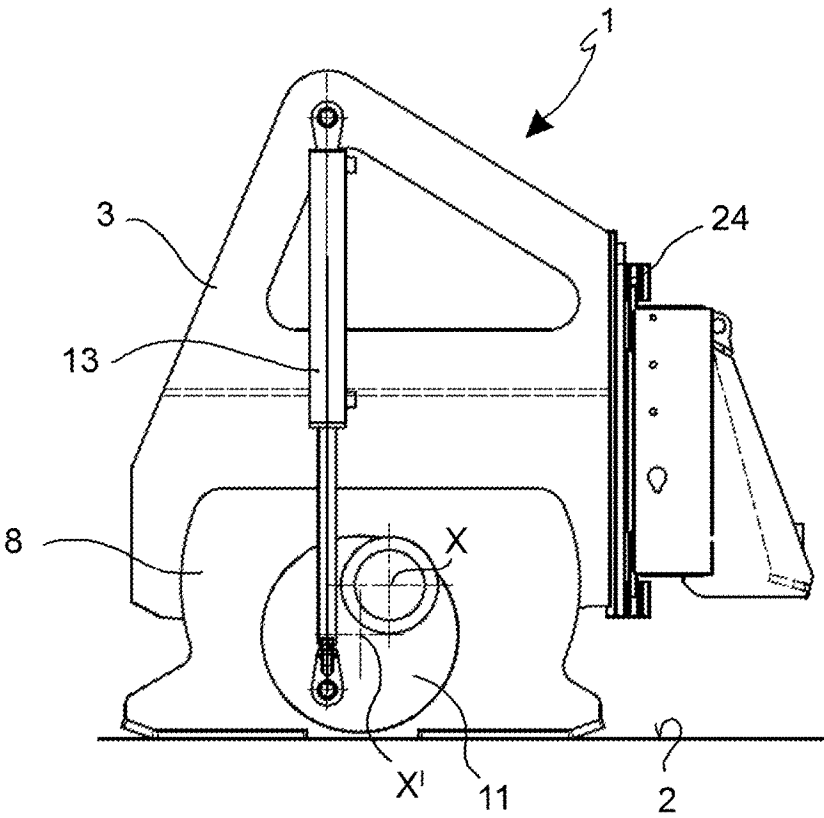
Figure 24:
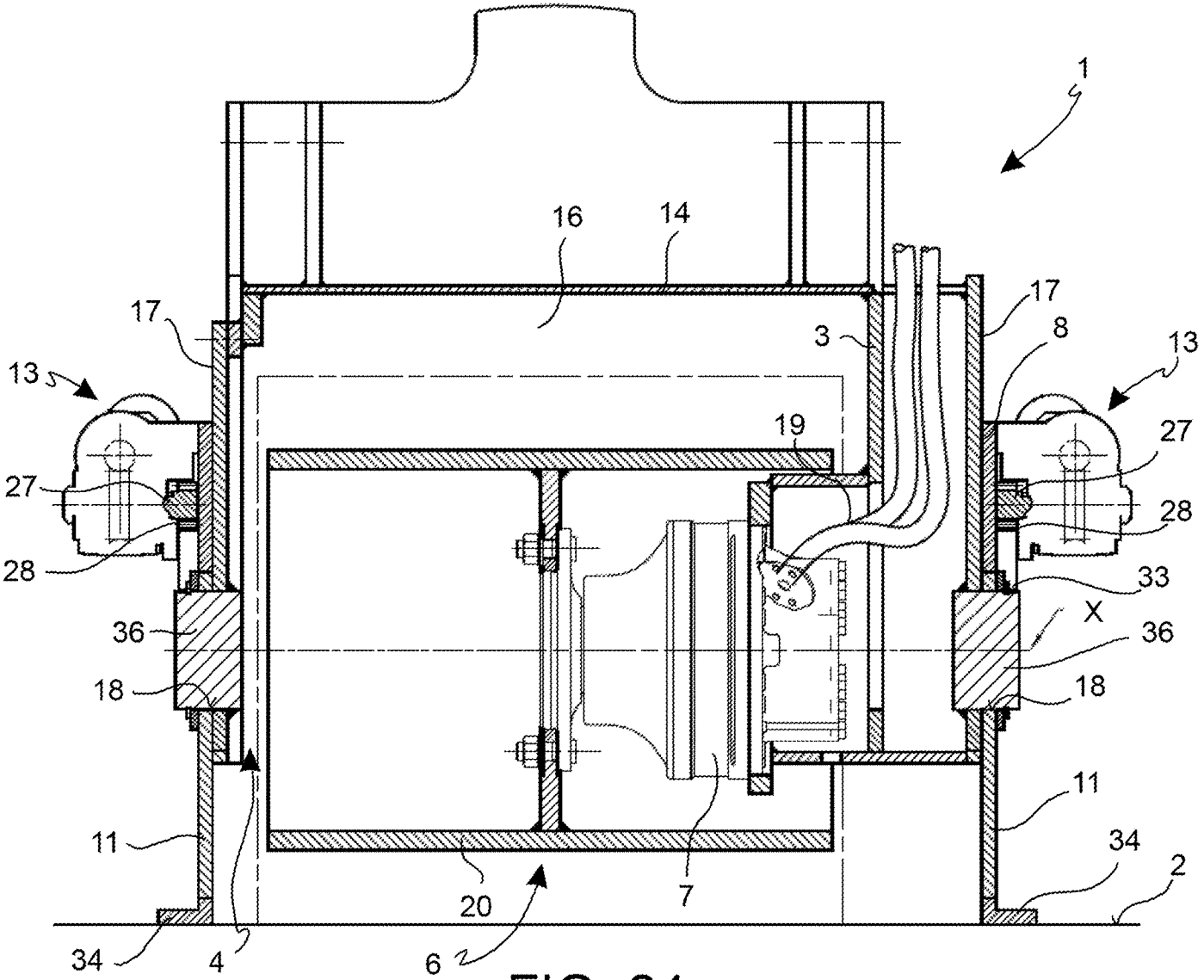
Figure 25:
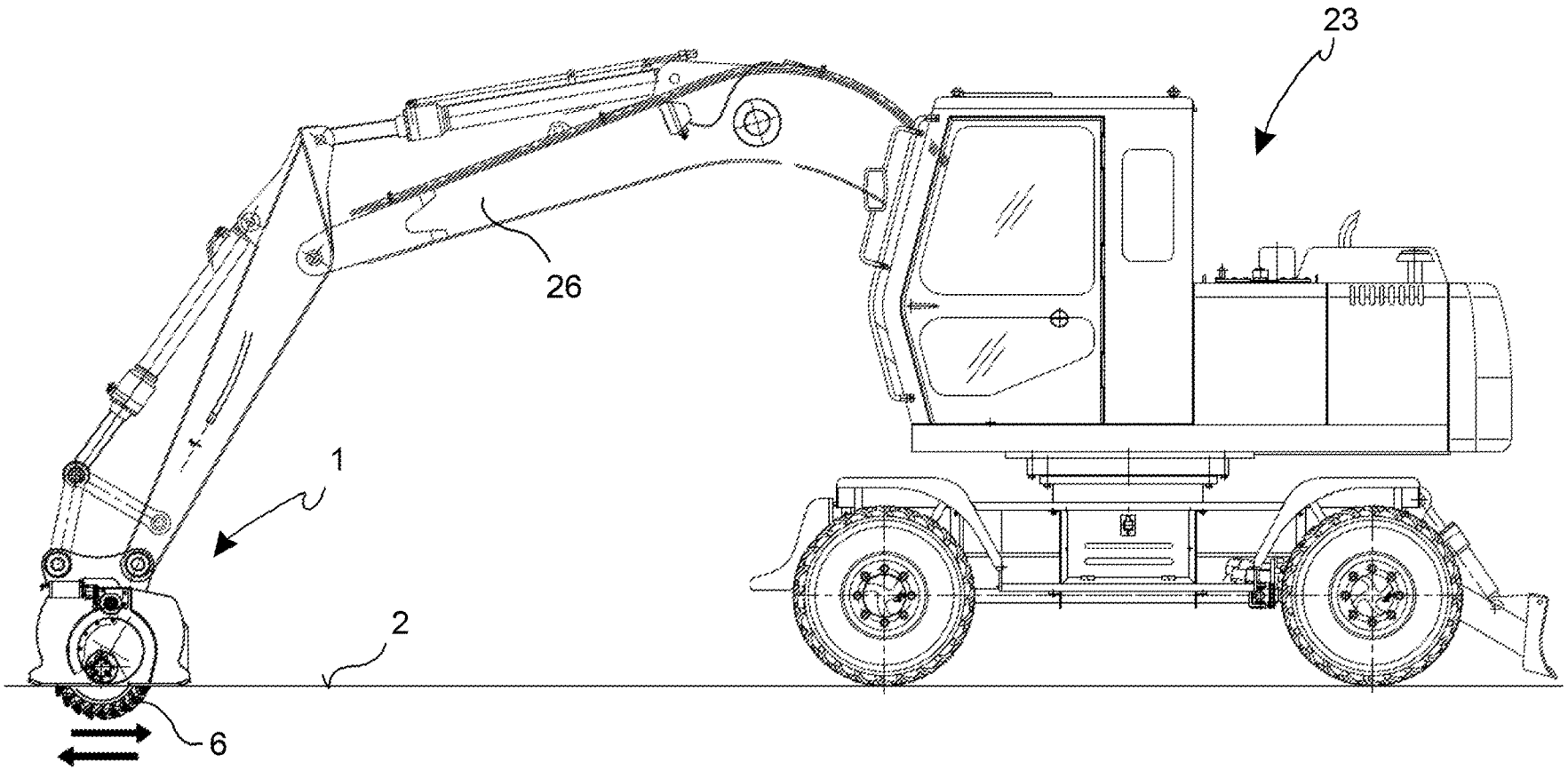
Figure 26:
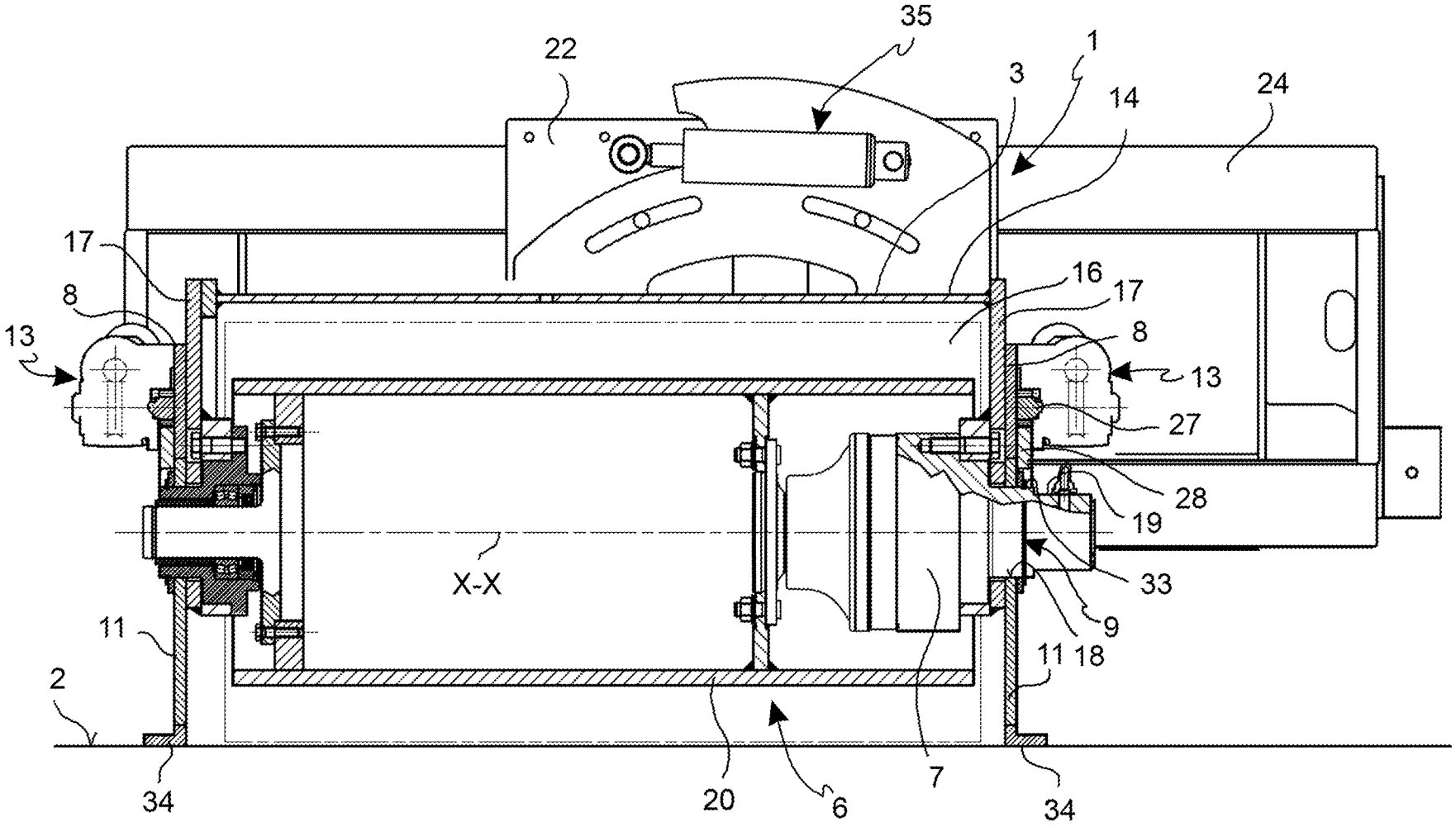
Figure 28:
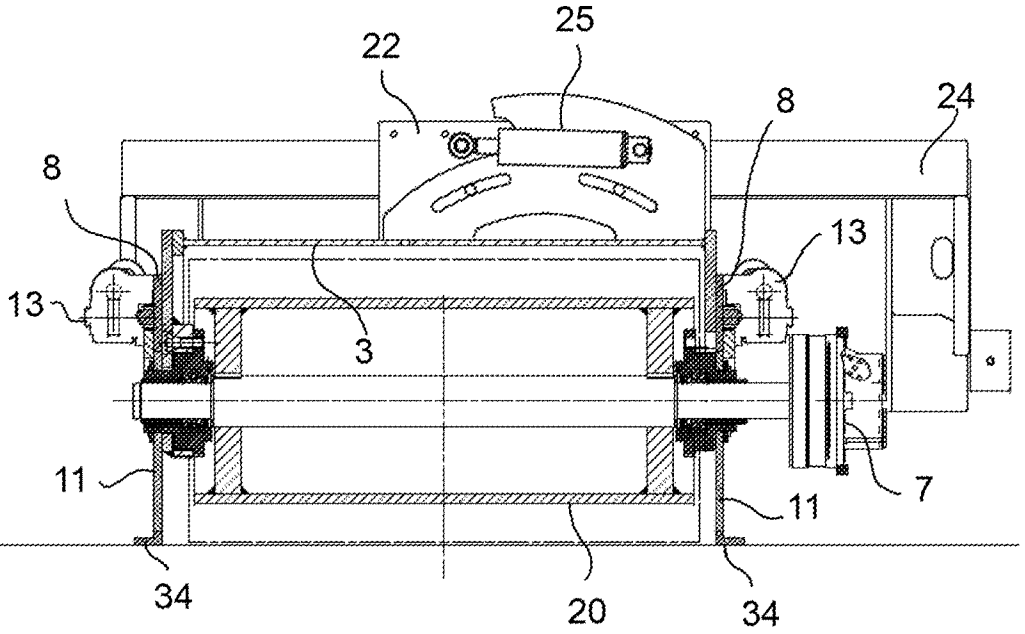
Figure 27:
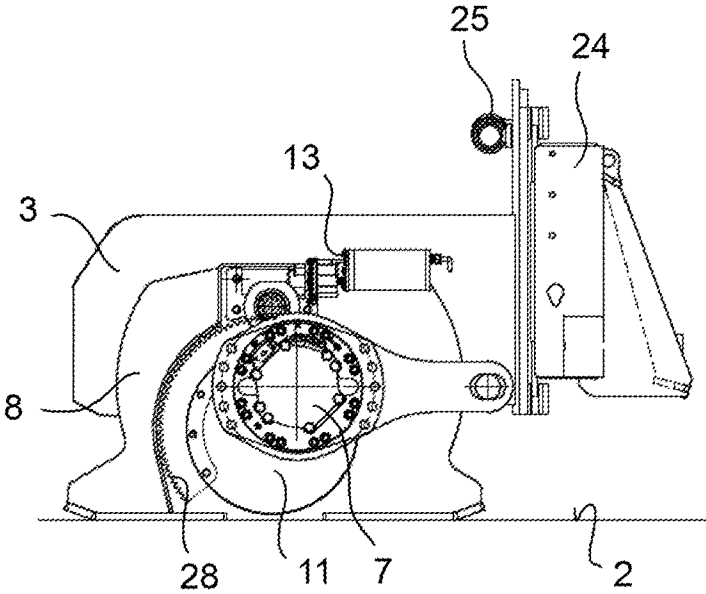
Figure 30:
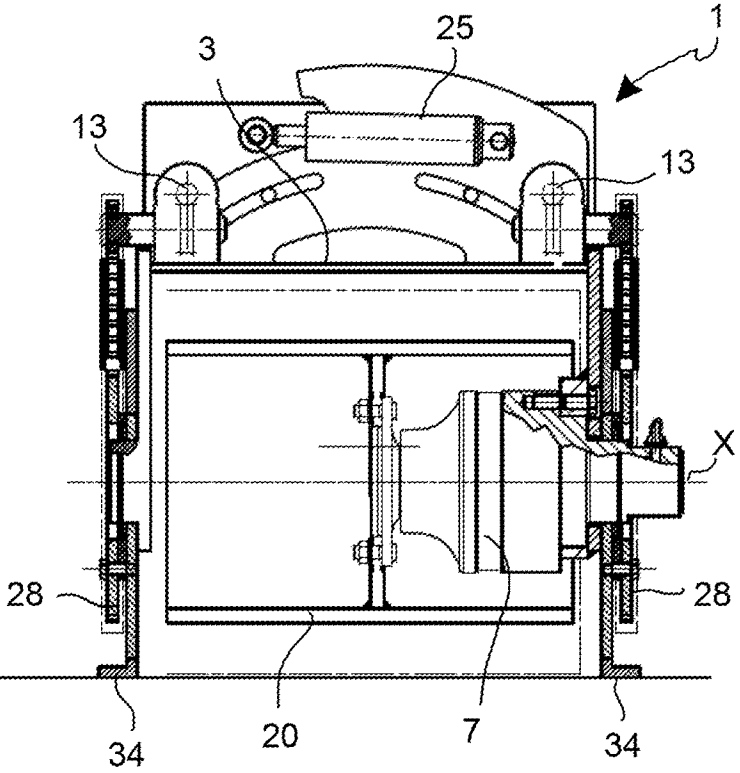
Figure 29:
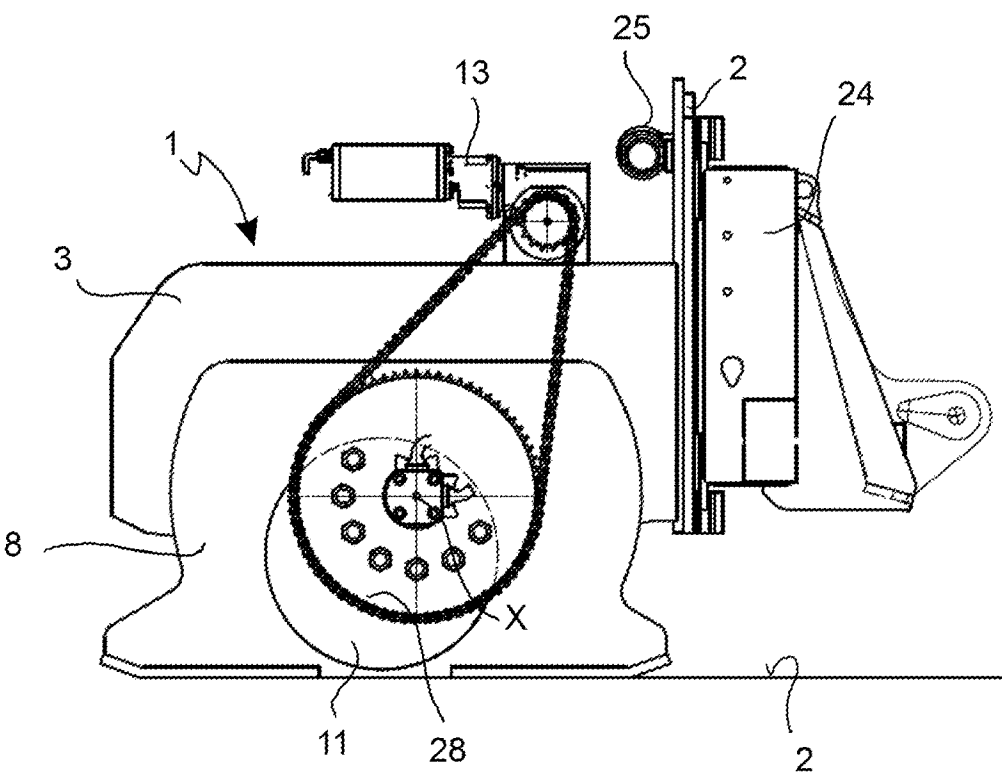
Figure 31:
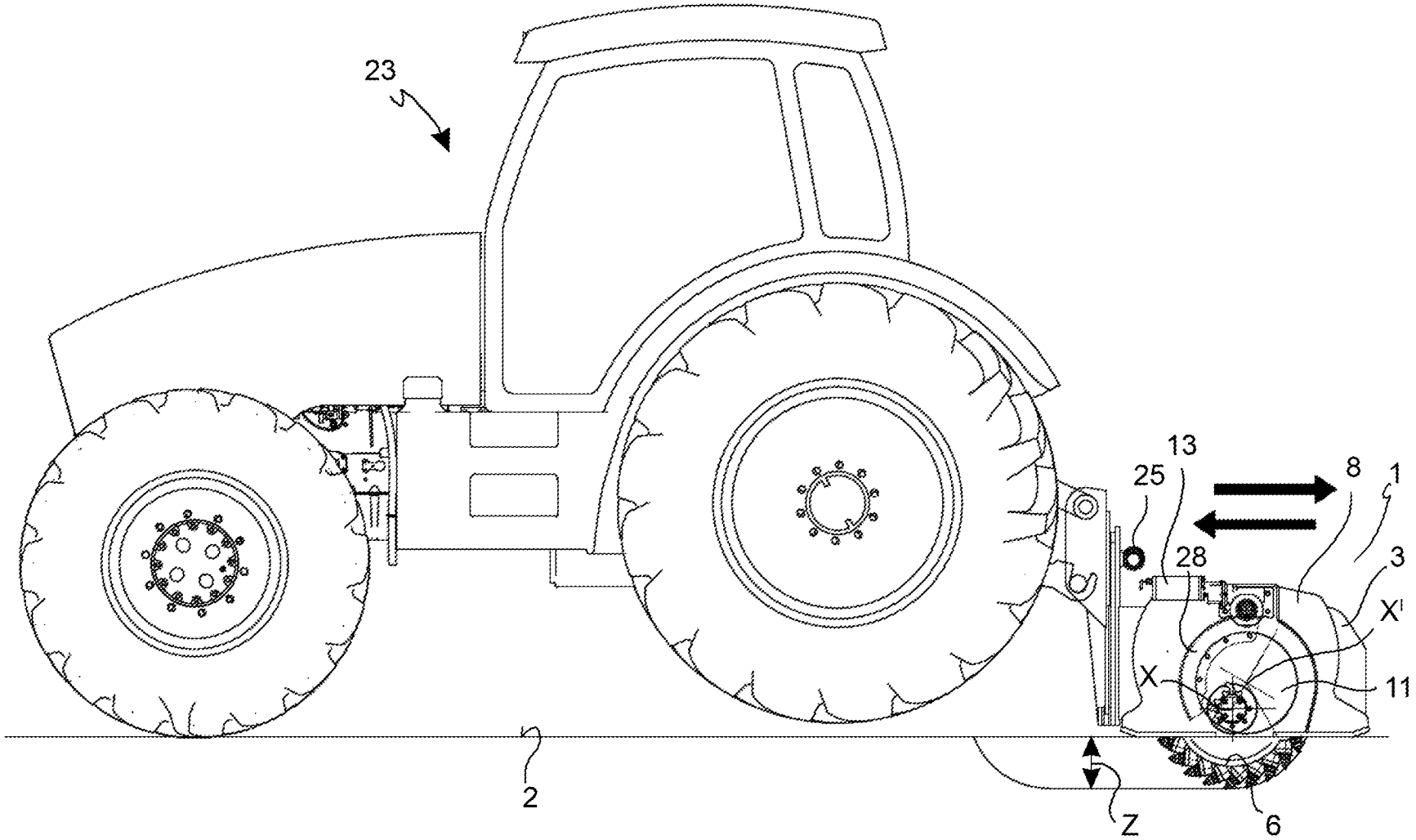

FIG. 10 shows a first milling phase on a road surface or ground to be milled, shown here in a partial cross-section, in which a first milling or passing depth is set and the angle between the perpendicular to the transverse translation guides and the theoretical plane of the road surface or ground to be milled is shown, and the angle of rotation of the eccentric plate in which the blade arm of the skid loader is in a first lowered position;

FIG. 11 shows a second milling phase of a road surface or ground to be milled, shown here in a partial cross-section, in which the same first milling or passing depth as in FIG. 10 is set and the angle between the perpendicular to the transverse translation guides and the theoretical plane of the road surface or ground to be milled is shown, and in which the blade arm of the skid loader is in a second raised position;

FIG. 12 shows a third milling phase on a road surface or ground to be milled, shown here in a partial cross-section, in which a second milling or passing depth greater than the first in FIGS. 10 and 11 is set, and the angle of rotation of the eccentric plate, which is greater than the angle in FIG. 10 so as to lower the support structure and therewith the cutter into the road surface or ground to be milled is shown, in which the blade arm of the skid loader is in a first lowered position;

FIG. 13 shows a front view of a skid loader in a first working position with the right wheel thereof on a raised area, such as a sidewalk, at a height greater than the left wheel, rotating the skid loader to the left in relation to vertical, a rotation indicated here by an angle y, and in which the excavating assembly is rotated with respect to the transverse translation guides in such a way as to keep the cutter axle substantially parallel to the theoretical plane of the road surface or ground to be milled;

FIG. 14 shows a front view of a skid loader in a second working position with the left wheel thereof on a raised area, such as a sidewalk, at a height greater than the right wheel, rotating the skid loader to the right in relation to vertical, a rotation indicated here by an angle y, and in which the excavating assembly is rotated with respect to the transverse translation guides in such a way as to keep the cutter axle substantially parallel to the theoretical plane of the road surface or ground to be milled;

FIG. 15 shows a cross-sectional front view of a excavating assembly according to another embodiment, in which the cutter has a predetermined axial length and partially houses two cutter movement units or cutter motors that protrude with their cutter axle extensions and are inserted into respective cutter axle extension seats of opposite eccentric plates held in opposite support elements;

FIG. 16 shows a side view of a skid loader on which a excavating assembly is installed at the front, in which an operator adjusts the angular position of the eccentric plate by means of a cutter movement unit actuated manually by a crank;

FIGS. 17, 18, and 19 show a side view of a excavating assembly according to another embodiment in which a linear actuator is placed between the support element and the eccentric plate, and in which three different positions of the eccentric plate are set, bringing the support structure to three positions and therefore three milling depths of the cutter on the road surface or ground to be milled, milling depths that gradually increase from FIG. 17 to FIG. 19;

FIGS. 20 and 21 show a side view of a excavating assembly according to yet another embodiment in which a linear actuator is linked by articulation to the support structure and, by means of levers, transmits a movement to the eccentric plate, and in which two different positions of the eccentric plate are set, bringing the support structure to two positions and therefore two milling depths of the cutter on the road surface or ground to be milled, milling depths that increase from FIG. 20 to FIG. 21;

FIGS. 22 and 23 show a side view of a excavating assembly according to another embodiment in which a linear actuator is placed between the support structure and the eccentric plate, and in which two different positions of the eccentric plate are set, bringing the support structure to two positions and therefore two milling depths of the cutter on the road surface or ground to be milled, milling depths that increase from FIG. 22 to FIG. 23;

FIG. 24 shows a cross-sectional front view of yet another embodiment in which a cutter movement unit or cutter motor is housed entirely inside the support structure and the support structure is freely articulated in the seat thereof in the eccentric plate by means of two opposing support structure shafts;

FIG. 25 shows a side view of a excavating assembly connected at the top to an articulated arm of an excavator so as to proceed with milling either by moving the cutter in a direction coinciding with the forward direction of operation of the excavator, or coinciding with the backward direction of operation of the excavator; it is also clear from this figure that the excavating assembly may also be moved by moving only the articulated arm of the excavator;

FIG. 26 shows a cross-sectional front view of another embodiment in which the cutter is supported by the support structure on one side thereof by means of the motor and, on the opposite side, by a shaft fitted to the support structure by bearings;

FIGS. 27 and 28 show a cross-sectional side view and front view of another embodiment in which the cutter motor is placed outside the support structure and is connected thereto and supported by means of a bracket, in which the cutter is fitted to a rotor shaft which, from the motor, passes through the entire support structure compartment and is fitted to the sides thereof by bearings;

FIGS. 29 and 30 show a side view and a front view of yet another embodiment in which the eccentric plate movement unit, in this case a gear motor, is supported by the support structure and is connected to the eccentric plate by a pinion meshing with a chain that in turn meshes with a toothed wheel attached to the eccentric plate but having the axis of rotation thereof perfectly aligned with the cutter axis X, making it possible to always have the same distance or gap between the axis of the pinion and the axis of the toothed wheel as the relative position of the support structure varies in relation to the support elements;

FIG. 31 shows a side view of a tractor supporting a excavating assembly behind the attachment and lifting arms thereof in order to mill either in the forward direction or in the backward direction.

DETAILED DESCRIPTION

According to a general embodiment, a excavating assembly 1 for milling and/or scarifying a road surface or ground to be milled 2 comprises a support structure 3.

Said support structure 3 delimits an internal chamber or compartment 4.

Said support structure 3 comprises a compartment opening 5 adapted to face said road surface or ground to be milled 2.

Said excavating assembly 1 comprises a cutter 6.

Said cutter 6 is housed in said compartment 4 of the support structure 3 in such a way as to rotate about a cutter axis X. For example, said cutter axis X is arranged in said support structure 3 so as to lie parallel to the theoretical surface of the road surface or ground to be milled 2.

Said cutter 6 protrudes from said compartment 4 through said compartment opening 5 in order to mill said road surface or ground to be milled 2.

Said excavating assembly 1 further comprises a cutter movement unit 7 connected to said cutter 6 and adapted to move the cutter 6.

Said cutter movement unit 7 is supported by said support structure 3.

Said excavating assembly 1 further comprises at least one support element 8 adapted to rest on said road surface or ground to be milled 2 during the milling operations.

Said at least one support element 8 is separated from said support structure 3.

Advantageously, said cutter 6 comprises a cutter axle extension 9 that protrudes from said support structure 3, thereby extending said cutter axis X.

Said support element 8 comprises an eccentric plate seat 10.

Said eccentric plate seat 10 rotatably houses an eccentric plate 11 so as to allow said eccentric plate 11 to rotate about a support element axis X'.

Said eccentric plate 11 comprises a cutter axle extension seat 12.

Said cutter axle extension seat 12 freely and rotatably houses said cutter axle extension 9. In other words, unless there are movements set by possible actuators placed between said support structure 3 and said support element 8, the support structure 3 may freely oscillate about said cutter axis X with respect to the support element 8.

Said cutter axis X, as extended by said cutter axle extension 9, is eccentric with respect to said support element axis X', defining a predetermined eccentricity e.

Said excavating assembly 1 further comprises an eccentric plate movement unit 13 connected to said eccentric plate 11 in order to move said eccentric plate about said support element axis X'.

According to a particular embodiment, said eccentric plate movement unit 13 is supported by said support structure 3 and is operatively connected to said eccentric plate 11 so as to move it inside said eccentric plate seat 10 thereof.

According to a particular embodiment, said eccentric plate movement unit 13 is supported by said support structure 3 and is operatively connected to said eccentric plate 11 so as to move it inside said eccentric plate seat 10 thereof. Said eccentric plate movement unit 13 is connected to and actuates eccentric plate movement levers 38. Said eccentric plate movement levers 38 are operatively connected to said eccentric plate 11 so as to move it in the eccentric plate seat 10 thereof provided in the support element 8.

According to a particular embodiment, said eccentric plate movement unit 13 is supported by said support element 8 and is operatively connected to said eccentric plate 11.

According to a particular embodiment, said eccentric plate movement unit 13 comprises a linear piston-cylinder actuator or a motor connected to an internal thread and worm screw. Said cylinder, or motor and internal threads, is rotatably supported by said support element 8, and said piston, or worm screw, is rotatably connected by the end thereof to said eccentric plate 11 at a predetermined distance from the cutter axis X.

According to a particular embodiment, said linear piston-cylinder actuator is a hydraulic actuator.

According to a particular embodiment, said linear piston-cylinder actuator is an electric actuator, for example a motor actuating an internal thread-worm screw assembly.

According to a particular embodiment, said eccentric plate movement unit 13 is supported by said support structure 3 and is operatively connected to said eccentric plate 11.

According to a particular embodiment, said eccentric plate movement unit 13 comprises a linear piston-cylinder actuator.

Said cylinder is rotatably supported by said support structure 3, and said piston is rotatably connected by the end thereof to said eccentric plate 11 at a predetermined distance from the cutter axis X.

According to a particular embodiment, said linear piston-cylinder actuator is a hydraulic actuator.

According to a particular embodiment, said linear piston-cylinder actuator is an electric actuator.

According to a particular embodiment, said at least one support element 8 consists of two support elements 8, each comprising an eccentric plate 11 thereof, placed at opposite ends of the support structure 3. Only one eccentric plate movement unit 13 is operatively connected by means of levers and gears to both said eccentric plates 11.

According to a particular embodiment, said cutter 6 comprises opposing cutter axle extensions 9 which protrude from opposite sides of said support structure 3, extending said cutter axis X on opposite sides.

Said excavating assembly 1 further comprises two opposing support elements 8 adapted to rest on said road surface or ground to be milled 2 during the milling operations, and placed on opposite sides of said support structure 3.

Each of said two opposing support elements 8 comprises an eccentric plate seat 10.

Each of said eccentric plate seats 10 rotatably houses a respective eccentric plate 11 so as to allow said eccentric plate 11 to rotate about a support element axis X'.

Each of said eccentric plates 11 comprises a cutter axle extension seat 12.

Each of said cutter axle extension seats 12 freely and rotatably houses a respective one of said cutter axle extensions 9.

Said cutter axis X, as extended by said cutter axle extensions 9, is eccentric with respect to said support element axis X', defining a predetermined eccentricity e.

According to a particular embodiment, one of the following alternatives is also envisaged:

said excavating assembly 1 further comprises an eccentric plate movement unit 13 connected to said eccentric plates 11 in order to move said eccentric plates about said support element axis X'.

or said excavating assembly 1 further comprises two eccentric plate movement units 13, each connected to a respective one of said eccentric plates 11 in order to move said eccentric plate 11 about said support element axis X'.

According to a particular embodiment, the portion of cutter 6 that protrudes from support element 8 is increased or decreased by rotating said eccentric plate 11 in said eccentric plate seat 10.

According to a particular embodiment, said cutter axis, or cutter rotation axis, X is parallel to said support element axis X'.

According to a particular embodiment, said at least one support element 8 consists of two support elements 8 placed at opposite ends of the support structure 3. Each support element 8 comprises an eccentric plate seat 10 which rotatably houses an eccentric plate 11 so as to allow said eccentric plate 11 to rotate about a support element axis X'; said eccentric plate 11 comprises a cutter axle extension seat 12 that freely and rotatably houses said cutter axle extension 9; and said cutter axis X as extended by said cutter axle extension 9 is eccentric with respect to said support element axis X', defining a predetermined eccentricity e; the excavating assembly 1 further comprising an eccentric plate movement unit 13 supported by said support element 8 or supported by said support structure 3 and connected to said eccentric plate 11 so as to move said eccentric plate about said support element axis X'.

According to a particular embodiment, said at least one support element 8 consists of two support elements 8 placed on opposite sides of the support structure 3. A first support element 8 comprises an eccentric plate seat 10 which rotatably houses an eccentric plate 11 so as to allow said eccentric plate 11 to rotate about a support element axis X'; said eccentric plate 11 comprises a cutter axle extension seat 12 that freely and rotatably houses said cutter axle extension 9; and said cutter axis X as extended by said cutter axle extension 9 is eccentric with respect to said support element axis X', defining a predetermined eccentricity e; the excavating assembly 1 further comprising an eccentric plate movement unit 13 supported by said support element 8 or supported by said support structure 3 and connected to said eccentric plate 11 so as to move said eccentric plate about said support element axis X'.

A second support element 8 comprises an eccentric plate seat 10 which rotatably houses an eccentric plate 11 so as to allow said eccentric plate 11 to rotate about a support element axis X'; said eccentric plate 11 comprises a cutter axle extension seat 12 that freely and rotatably houses a support structure shaft 36 integrally attached to said support structure 3; and said cutter axis X is extended in said support structure shaft 36 and is eccentric with respect to said support element axis X', defining a predetermined eccentricity e; the excavating assembly 1 further comprising an eccentric plate movement unit 13 supported by said support element 8 or supported by said support structure 3 and connected to said eccentric plate 11 so as to move said eccentric plate about said support element axis X'.

According to a particular embodiment, said cutter 6 is supported by said support structure 3 at least by means of the cutter movement unit or cutter motor 7.

According to a particular embodiment, said cutter axis X and the axis of the cutter movement unit or cutter motor 7 coincide with each other.

According to a particular embodiment, said cutter axle extension 9 is part of the cutter movement unit 7.

According to a particular embodiment, said support structure 3 is a box structure.

According to a particular embodiment, said support structure 3 is a closed box structure with the exception of said compartment opening 5 from which said cutter 6 protrudes.

According to a particular embodiment, said support structure 3 is a box structure that comprises an upper plate 14, a front plate 15, a rear plate 16, and sides 17 opposite each other with respect to said cutter 6; and/or in which said sides 17 are connected by separable means to said upper plate 14, front plate 15, and rear plate 16 so that the same type of sides 17 may be used for support structures 3 having widths according to different axial extensions.

According to a particular embodiment, said support structure 3 is a box structure that comprises an upper plate 14, a front plate 15, a rear plate 16, and sides 17 opposite each other with respect to said cutter 6; and in which at least one side 17 comprises a cutter support seat 18 defining a cutter axis of rotation or cutter axis X.

According to a particular embodiment, said support structure 3 is a box structure which comprises an upper plate 14 with which a piece of excavating assembly service equipment, such as a tank for a fluid, is associated.

According to a particular embodiment, said cutter support seat 18 is a motor seat that accommodates a portion of said cutter movement unit or cutter motor 7.

According to a particular embodiment, said cutter movement unit 7 comprises said cutter axle extension 9; a portion of said cutter axle extension 9 protrudes out of the support structure 3 and comprises power supply connections 19 adapted to connected the power supply to said cutter movement unit 7.

According to a particular embodiment, said cutter movement unit or cutter motor 7 comprises a hydraulic motor. According to a particular embodiment, said cutter movement unit or cutter motor 7 comprises an electric motor.

According to a particular embodiment, said cutter movement unit or cutter motor 7 is completely housed inside the support structure 3.

According to a particular embodiment, said cutter movement unit or cutter motor 7 is completely housed inside the support structure 3 with the exception of the extension portion of the cutter axle 9.

According to a particular embodiment, said cutter movement unit or cutter motor 7 is housed inside said cutter 6. According to a particular embodiment, said cutter movement unit or cutter motor 7 is housed outside said cutter 6.

According to a particular embodiment, said cutter 6 is a cutter cylinder having a cutter cover 20 which supports a plurality of cutting tools 21 in a cantilever fashion.

According to a particular embodiment, said support structure 3 is oscillatingly connected to a connection element 22 for connection to a loading machine 23, such as a skid steer excavator or an agricultural machine or a road tractor or a self-propelled machine, for example a skid steer loader or skid loader.

According to a particular embodiment, said support structure 3 is oscillatingly connected to a connection element 22 for connection to a loading machine 23, for example excavator 23 with an articulated arm 26.

According to a particular embodiment, said connection element 22 is slidably connected to transverse translation guides 24 defining an axis of translation T.

According to a particular embodiment, said axis of translation T is parallel to said cutter axis X.

According to a particular embodiment, said support structure 3 is oscillatingly connected to an attachment element 22 so as to allow said excavating assembly 1 to oscillate about an axis of oscillation Zo.

According to a particular embodiment, said axis of oscillation Zo is orthogonal to the cutter axis X.

According to a particular embodiment, said excavating assembly 1 comprises a cutter oscillation unit 25; said cutter oscillation unit 25 is placed between a connection element 22 for connection of the excavating assembly 1 to a loading machine 23, and said support structure 3 to adjust an oscillation of the excavating assembly 1 about an axis of oscillation Zo.

According to a particular embodiment, said connection element 22 is arranged opposite the travel direction of the milling so that said excavating assembly 1 is placed in front of a loading machine 23 with respect to the travel direction thereof, for example for connection to a front arm 26 of a skid steer loader or skid loader 23 and to allow milling both in a forward direction and in a backward direction of said loading machine 23.

According to a particular embodiment, said connection element 22 is arranged in the advancing direction of the milling so that said excavating assembly 1 is placed behind a loading machine 23 with respect to the travel direction thereof, for example for connection to rear support and lifting arms of a tractor 23 and to allow milling both in a forward direction and in a backward direction of said loading machine 23.

According to a particular embodiment, said eccentric plate movement unit 13 comprises a gearmotor.

According to a particular embodiment, said eccentric plate movement unit 13 comprises an electric motor.

According to a particular embodiment, said eccentric plate movement unit 13 comprises a hydraulic motor.

According to a particular embodiment, said eccentric plate movement unit 13 comprises a gear driven by a crank 35 which may be associated therewith by separable means.

According to a particular embodiment, said eccentric plate movement unit 13 comprises a pinion 27.

Said eccentric plate 11 comprises a rack 28.

Said pinion 27 meshes with said rack 28.

According to a particular embodiment, said rack 28 is arch-shaped to control the oscillation movement of the eccentric plate 11 in said eccentric plate seat 10.

According to a particular embodiment, said eccentric plate seat 10 is an open seat.

According to a particular embodiment, said eccentric plate seat 10 is a closed seat.

According to a particular embodiment, said eccentric plate seat 10 comprises at least one seat edge 29; said seat edge 29 accommodates and guides the oscillation of said eccentric plate 11.

According to a particular embodiment, said eccentric plate 11 comprises at least one eccentric plate edge 37; said eccentric plate edge 37 is accommodated and guided by said at least one seat edge 29.

According to a particular embodiment, said cutter axle extension seat 12 is an open seat.

According to a particular embodiment, said cutter axle extension seat 12 is a closed seat.

According to a particular embodiment, said cutter axle extension 9 comprises a motor guide 30; said cutter axle extension seat 12 is fitted to said motor guide 30.

According to a particular embodiment, said motor guide 30 comprises a seat shoulder 31 and a Seeger ring seat 32; said eccentric plate 11, when fitted to said motor guide 30 of said cutter axle extension 9 with the motor seat 18 thereof, is placed between said seat shoulder 31 and a Seeger ring 33 removably received into said Seeger ring seat 32.

According to a particular embodiment, said support element 8 comprises support element runners 34 adapted to rest on said road surface or ground to be milled 2.

According to a particular embodiment, said excavating assembly 1 may be removably applied or secured to a vehicle, such as a skid steer loader or skid loader or excavator.

The present invention also relates to a operating machine or operating machine or simply 23 comprising a excavating assembly 1 as described in any one of the preceding embodiments.

According to a particular embodiment, said excavating assembly is removably associated with the operating or loading machine 23 at the front thereof with respect to the direction of operation of the operating or loading machine 23.

The present invention also relates to a method for adjusting a excavating assembly 1 comprising the following steps:

providing a excavating assembly according to any one of the embodiments described above;

moving said eccentric plate 11 in said eccentric plate seat 10 so as to move the eccentric arrangement of said cutter axis X with respect to said support element axis X' by moving said eccentricity e, thus increasing or decreasing the portion of the cutter 6 protruding from the support element 8 and modifying the cut depth z when the excavating assembly is pressed against the road surface or ground to be milled 2.

According to a particular embodiment of the method for adjusting a excavating assembly, the following additional steps are provided either separately or in combination:

independently moving each eccentric plate 11 of each opposing support element 8;

freely oscillating the support structure 3 in relation to the support element 8 so as to adapt the angle between the support structure 3 and the road surface or ground to be milled 2;

adapting the angle of the connection element 22 in relation to the road surface or ground to be milled 2.

LIST OF REFERENCE NUMBERS

1 excavating assembly
2 road surface or ground to be milled
3 support structure
4 compartment or support structure compartment
5 compartment opening
6 cutter or cutter cylinder
7 cutter movement unit or cutter motor
8 support element or support plate
9 cutter axle extension
10 eccentric plate seat
11 eccentric plate
12 cutter axle extension seat
13 eccentric plate movement unit
14 upper plate
15 front plate
16 rear plate
17 side
18 cutter support seat or motor seat
19 power supply connections
20 cutter cover
21 cutter tools
22 connection element
23 loading machine, for example a skid steer loader or skid loader or excavator
24 transverse translation guides
25 cutter oscillation unit
26 front arm or articulated arm
27 pinion
28 rack
29 seat edge
30 motor guide
31 seat shoulder
32 Seeger ring seat
33 Seeger ring
34 support element runners
35 crank
36 support structure shaft
37 eccentric plate edge
38 eccentric plate movement levers
X cutter axis or cutter axis of rotation
X' support element axis
e eccentricity
T axis of translation of the excavating assembly
Zo excavating assembly axis of oscillation or axis of oscillation
z cut depth

The invention claimed is:

1. An excavating assembly for milling and/or scarifying a road surface or ground to be milled, wherein said excavating assembly comprises a support structure delimiting a compartment, said support structure comprising a compartment opening adapted to face said road surface or ground to be milled;

said excavating assembly further comprises a cutter, said cutter being housed in said compartment of the support structure so as to be rotatable about a cutter axis and protruding from said compartment through said compartment opening to mill said road surface or ground to be milled;

said excavating assembly further comprises a cutter movement unit connected to said cutter, said cutter movement unit being supported by said support structure;

said excavating assembly further comprises at least one support element adapted to rest on said road surface or ground to be milled during milling operations, said at least one support element being separate from said support structure;

wherein said cutter comprises a cutter axle extension protruding from said support structure thus extending said cutter axis;

said at least one support element comprises an eccentric plate seat;

said eccentric plate seat rotatably houses an eccentric plate so as to allow said eccentric plate to rotate about a support element axis;

said eccentric plate comprises a cutter axle extension seat;

said cutter axle extension seat houses said cutter axle extension so as to be freely rotatable;

said cutter axis, as extended by said cutter axle extension, is eccentric with respect to said support element axis, defining a predetermined eccentricity;

said excavating assembly further comprises an eccentric plate movement unit connected to said eccentric plate for moving said eccentric plate about said support element axis; and said support structure is oscillatingly connected to a connection element to allow said excavating assembly to oscillate about an axis of oscillation.

2. The excavating assembly of claim 1, wherein, alternatively, one of the following options is provided:

said eccentric plate movement unit supports said support structure and is operatively connected to said eccentric plate for moving the eccentric plate in said eccentric plate seat;

or said eccentric plate movement unit supports said support structure and is operatively connected to said eccentric plate for moving the eccentric plate in said eccentric plate seat;

said eccentric plate movement unit is connected to and actuates eccentric plate movement levers; said eccentric plate movement levers are operatively connected to said eccentric plate for moving the eccentric plate in the eccentric plate seat provided in the at least one support element;

or said eccentric plate movement unit supports said at least one support element and is operatively connected to said eccentric plate;

or said eccentric plate movement unit comprises a linear piston-cylinder actuator or a motor connected to an internal thread and worm screw; wherein said cylinder or motor and internal thread are rotatably supported by said at least one support element and said piston or worm screw is rotatably connected with an end thereof to said eccentric plate at a predetermined distance from the cutter axis; and/or wherein said linear piston-cylinder actuator is a hydraulic actuator; and/or wherein said linear piston-cylinder actuator is an electric actuator;

or said eccentric plate movement unit is supported by said support structure and operatively connected to said eccentric plate;

or said eccentric plate movement unit comprises a linear piston-cylinder actuator; wherein said cylinder is rotatably supported by said support structure and said piston is rotatably connected at an end thereof to said eccentric plate at a predetermined distance from the cutter axis; and/or wherein said linear piston-cylinder actuator is a hydraulic actuator; and/or wherein said linear piston-cylinder actuator is an electric actuator.

3. The excavating assembly of claim 1, wherein said cutter comprises opposite cutter axle extensions protruding on opposite sides from said support structure thus extending, on opposite sides, said cutter axis;

said excavating assembly further comprises two opposite support elements adapted to rest on said road surface or ground to be milled during the milling operations and placed on opposite sides of said support structure;

each of said two opposite support elements comprises an eccentric plate seat;

each of said eccentric plate seats rotatably houses a respective eccentric plate so as to allow said respective eccentric plate to rotate about the support element axis;

each of said eccentric plates comprises a cutter axle extension seat;

each of said cutter axle extension seats houses a respective one of said cutter axle extensions so as to be freely rotatable;

said cutter axis, as extended by said cutter axle extensions, is eccentric with respect to said support element axis, defining a predetermined eccentricity;

and wherein one of the following alternatives is provided:

said excavating assembly further comprises an eccentric plate movement unit connected to said eccentric plates for moving said eccentric plates about said support element axis or said excavating assembly further comprises two eccentric plate movement units each connected to a respective one of said eccentric plates for moving said respective eccentric plate about said support element axis.

4. The excavating assembly of claim 1, wherein said at least one support element consists of two support elements placed on opposite sides of the support structure; wherein each of said two support elements comprises an eccentric plate seat that rotatably houses an eccentric plate so as to allow said eccentric plate to rotate about the support element axis; and wherein said eccentric plate comprises a cutter axle extension seat and said cutter axle extension seat houses said cutter axle extension so as to be freely rotatable; wherein said cutter axis as extended by said cutter axle extension is eccentric with respect support element axis, defining a predetermined eccentricity; and wherein said excavating assembly further comprises an eccentric plate movement unit supported by said support element or by said support structure and connected to said eccentric plate for moving said eccentric plate about said support element axis.

5. The excavating assembly of claim 1, wherein said at least one support element consists of two support elements placed on opposite sides of the support structure; wherein a first support element comprises an eccentric plate seat that rotatably houses an eccentric plate so as to allow said eccentric plate to rotate about the support element axis; wherein said eccentric plate comprises a cutter axle extension seat; wherein said cutter axle extension seat houses said cutter axle extension so as to be freely rotatable; wherein said cutter axis as extended by said cutter axle extension is eccentric with respect to said support element axis, defining a predetermined eccentricity; and wherein said excavating assembly further comprises an eccentric plate movement unit supported by said support element or by said support structure and connected to said eccentric plate for moving said eccentric plate about said support element axis; and wherein a second support element comprises an eccentric plate seat that rotatably houses an eccentric plate so as to allow said eccentric plate to rotate about the support element axis; wherein said eccentric plate comprises a cutter axle extension seat; wherein said cutter axle extension seat houses a support structure shaft integrally fixed to said support structure so as to be freely rotatable; wherein said cutter axis extends into said support structure shaft and is eccentric with respect to said support element axis, defining a predetermined eccentricity; and wherein said excavating assembly further comprises an eccentric plate movement unit supported by said support element or supported by said support structure and connected to said eccentric plate for moving said eccentric plate about said support element axis.

6. The excavating assembly of claim 1, wherein said support structure is a box structure comprising an upper plate, a front plate, a rear plate and sides that are opposite to each other with respect to said cutter; and/or wherein said sides are separably connected to said upper plate, front plate and rear plate for allowing a same type of sides to be used for support structures having different width according to axial extension;

or said support structure is a box structure comprising an upper plate, a front plate, a rear plate and sides that are opposite to each other with respect to said cutter; and wherein at least one side comprises a cutter support seat defining the cutter axis.

7. The excavating assembly of claim 6, wherein said cutter support seat is a motor seat that houses a portion of said cutter movement unit.

8. The excavating assembly of claim 1, wherein said support structure is a box structure comprising an upper plate with which a service equipment for the excavating assembly is associated, the service equipment being a tank for a fluid.

9. The excavating assembly of claim 1, wherein said cutter movement unit is completely housed inside the support structure except for the cutter axle extension.

10. The excavating assembly of claim 1, wherein said connection element is for connection to an operating machine, the operating machine being one of a skid steer excavator, an agricultural machine, a road tractor or a self-propelled machine, or a skid steer loader.

11. The excavating assembly of claim 1, wherein said connection element is for connection to an operating machine, the operating machine being an articulated arm excavator.

12. The excavating assembly of claim 11, wherein said connection element is slidably connected to transverse translation guides defining an axis of translation.

13. The excavating assembly of claim 12, wherein said axis of translation is parallel to said cutter axis.

14. The excavating assembly of claim 1, wherein said excavating assembly comprises a cutter oscillation unit; said cutter oscillation unit being placed between said connection element for connecting the excavating assembly to an operating machine, and said support structure for adjusting an oscillation of the excavating assembly about an axis of oscillation.

15. The excavating assembly of claim 14, wherein said connection element is arranged opposite to a direction of milling so that said excavating assembly is placed in front of the operating machine, with respect to a travel direction thereof, for connection to a front boom of a skid steer loader, and to allow milling both in a forward direction and in a backward direction of said operating machine.

16. The excavating assembly of claim 14, wherein said connection element is arranged in a direction of milling so that said excavating assembly is placed behind the operating machine, with respect to a travel direction thereof, for connection to rear support and lifting arms of a tractor and to allow milling both in a forward direction and in a backward direction of said operating machine.

17. The excavating assembly of claim 1, wherein said cutter axle extension comprises a motor guide, and wherein said cutter axle extension seat is fitted onto said motor guide.

18. The excavating assembly of claim 17, wherein said motor guide comprises a seat shoulder and a Seeger ring seat, and wherein said eccentric plate, when the cutter axle extension seat is fitted onto said motor guide of said cutter axle extension, is placed between said seat shoulder and a Seeger ring removably accommodated in said Seeger ring seat.

19. The excavating assembly of claim 1, wherein said at least one support element comprises support element runners adapted to rest on said road surface or ground to be milled.

20. An assembly comprising an operating machine comprising an excavating assembly as defined in claim 1.

21. A method for adjusting an excavating assembly, said method comprising:

providing an excavating assembly for milling and/or scarifying a road surface or ground to be milled, wherein said excavating assembly comprises a support structure delimiting a compartment, said support structure comprising a compartment opening adapted to face said road surface or ground to be milled;

said excavating assembly further comprises a cutter, said cutter being housed in said compartment of the support structure so as to be rotatable about a cutter axis and protruding from said compartment through said compartment opening to mill said road surface or ground to be milled;

said excavating assembly further comprises a cutter movement unit connected to said cutter, said cutter movement unit being supported by said support structure;

said excavating assembly further comprises at least one support element adapted to rest on said road surface or ground to be milled during milling operations, said at least one support element being separate from said support structure;

wherein said cutter comprises a cutter axle extension protruding from said support structure thus extending said cutter axis;

said at least one support element comprises an eccentric plate seat;

said eccentric plate seat rotatably houses an eccentric plate so as to allow said eccentric plate to rotate about a support element axis;

said eccentric plate comprises a cutter axle extension seat;

said cutter axle extension seat houses said cutter axle extension so as to be freely rotatable;

said cutter axis, as extended by said cutter axle extension, is eccentric with respect to said support element axis, defining a predetermined eccentricity;

said excavating assembly further comprises an eccentric plate movement unit connected to said eccentric plate for moving said eccentric plate about said support element axis; and said support structure is oscillatingly connected to a connection element to allow said excavating assembly to oscillate about an axis of oscillation; and moving said eccentric plate in said eccentric plate seat so as to move eccentric arrangement of said cutter axis with respect to said support element axis thus displacing said predetermined eccentricity, increasing or decreasing the cutter portion protruding from the at least one support element, and modifying a cut depth when the excavating assembly is pressed against the road surface or ground to be milled.

22. The method of claim 21, the method further comprising independently moving the eccentric plate of the at least one support element.

23. The method of claim 21, the method further comprising freely oscillating the support structure with respect to the at least one support element for adapting an angle between the support structure and the road surface or ground to be milled;

or for adapting an angle of said connection element with respect to the road surface or ground to be milled.

24. An excavating assembly for milling and/or scarifying a road surface or ground to be milled, wherein said excavating assembly comprises a support structure delimiting a compartment, said support structure comprising a compartment opening adapted to face said road surface or ground to be milled;

said excavating assembly further comprises a cutter, said cutter being housed in said compartment of the support structure so as to be rotatable about a cutter axis and protruding from said compartment through said compartment opening to mill said road surface or ground to be milled;

said excavating assembly further comprises a cutter movement unit connected to said cutter, said cutter movement unit being supported by said support structure;

said excavating assembly further comprises at least one support element adapted to rest on said road surface or ground to be milled during milling operations, said at least one support element being separate from said support structure;

wherein said cutter comprises a cutter axle extension protruding from said support structure thus extending said cutter axis, said cutter axle extension comprising a motor guide;

said at least one support element comprises an eccentric plate seat;

said eccentric plate seat rotatably houses an eccentric plate so as to allow said eccentric plate to rotate about a support element axis;

said eccentric plate comprises a cutter axle extension seat;

said cutter axle extension seat is fitted onto said motor guide and houses said cutter axle extension so as to be freely rotatable;

said cutter axis, as extended by said cutter axle extension, is eccentric with respect to said support element axis, defining a predetermined eccentricity; and said excavating assembly further comprises an eccentric plate movement unit connected to said eccentric plate for moving said eccentric plate about said support element axis.

* * * * *